US010028870B2

(12) United States Patent
Olsson

(10) Patent No.: US 10,028,870 B2
(45) Date of Patent: Jul. 24, 2018

(54) POWERED WHEELCHAIR

(71) Applicant: REAC AB, Amal (SE)

(72) Inventor: Carl Johan Olsson, Amal (SE)

(73) Assignee: REAC AB, Amal (SE)

( * ) Notice: Subject to any disclaimer, the term of this patent is extended or adjusted under 35 U.S.C. 154(b) by 108 days.

(21) Appl. No.: 15/307,993

(22) PCT Filed: Apr. 29, 2014

(86) PCT No.: PCT/EP2014/058662
§ 371 (c)(1),
(2) Date: Oct. 31, 2016

(87) PCT Pub. No.: WO2015/165500
PCT Pub. Date: Nov. 5, 2015

(65) Prior Publication Data

US 2017/0056259 A1 Mar. 2, 2017

(51) Int. Cl.
*A61G 5/10* (2006.01)
*A61G 5/04* (2013.01)
(Continued)

(52) U.S. Cl.
CPC ..... *A61G 5/042* (2013.01); *A61G 5/06* (2013.01); *A61G 5/1056* (2013.01);
(Continued)

(58) Field of Classification Search
CPC .... A61G 5/1086; A61G 5/1089; A61G 5/042; A61G 5/1056; A61G 5/128; A61G 5/06; A61G 2203/42; A61G 2203/14
See application file for complete search history.

(56) References Cited

U.S. PATENT DOCUMENTS 4,310,167 A 1/1982 McLaurin
5,011,175 A 4/1991 Nicholson et al.
(Continued)

FOREIGN PATENT DOCUMENTS

WO 2006012699 A1 2/2006
WO 2007022387 A2 2/2007

OTHER PUBLICATIONS

International Search Report and Written Opinion for PCT/EP2014/058662 dated Jan. 22, 2015.

*Primary Examiner* — James A English
(74) *Attorney, Agent, or Firm* — Olive Law Group, PLLC

(57) ABSTRACT

The invention relates to a powered wheelchair for transporting a person, comprising a seat frame for supporting the person, a pair of opposing main wheel assemblies, including a first main wheel assembly and a second main wheel assembly connected to the seat frame, and a third main wheel assembly arranged spaced apart from the pair of opposing main wheel assemblies and connected to said seat frame. The powered wheelchair further comprises a support wheel arrangement for supporting the powered wheelchair, said support wheel arrangement having a main beam and a front support wheel unit capable of being applied to a ground surface. The main beam is rotatably connected to said third main wheel assembly at a third connection point and connected via a guiding mechanism to the first main wheel assembly at a first connection point. The main beam has a first portion adapted to cooperate with said guiding mechanism when said first portion passes through a part of the guiding mechanism upon movement of the main beam relative to the guiding mechanism, to maintain said support wheel arrangement in a supporting position, in which the front support wheel unit is applied to the ground surface.

14 Claims, 8 Drawing Sheets

(51) Int. Cl.
*A61G 5/06* (2006.01)
*A61G 5/12* (2006.01)

(52) U.S. Cl.
CPC ..... *A61G 5/1086* (2016.11); *A61G 5/1089* (2016.11); *A61G 5/128* (2016.11); *A61G 2203/14* (2013.01); *A61G 2203/42* (2013.01)

(56) References Cited

U.S. PATENT DOCUMENTS

| | | | | |
|---|---|---|---|---|
| 9,351,889 | B2 * | 5/2016 | Mulhern | A61G 5/04 |
| 2006/0201723 | A1 * | 9/2006 | Hsu | A61G 5/043<br>180/24.02 |
| 2007/0152427 | A1 | 7/2007 | Olsen | |
| 2009/0166996 | A1 * | 7/2009 | Spindle | A61G 5/00<br>280/250.1 |
| 2011/0083913 | A1 * | 4/2011 | Cuson | A61G 5/06<br>180/65.1 |
| 2012/0295778 | A1 * | 11/2012 | Johansson | A61G 5/10<br>482/131 |
| 2012/0304807 | A1 * | 12/2012 | Ohruh | B62D 61/10<br>74/572.2 |
| 2016/0143793 | A1 * | 5/2016 | Holub | A61G 5/1056<br>297/311 |
| 2017/0071804 | A1 * | 3/2017 | Olsson | A61G 5/042 |

* cited by examiner

POWERED WHEELCHAIR

CROSS REFERENCE TO RELATED APPLICATIONS

This application is a 35 USC 371 application of International PCT Patent Application No. PCT/EP2014/058662, filed on Apr. 29, 2014; the content of which is hereby incorporated by reference herein in its entirety.

FIELD OF THE INVENTION

The invention relates to a powered wheelchair for transporting a person. Although the invention will be described in relation to an electric-powered wheelchair, the invention is not restricted to a wheelchair having this particular power source, but may also be used in other types of powered wheelchairs and/or power-assisted wheelchair.

BACKGROUND OF THE INVENTION

Wheelchairs are important devices for people suffering from conditions which reduce their capability to walk, for example as a result of illness, injury, or disability. A wheelchair may increase the quality of life for millions of people suffering from such conditions.

More recently, powered wheelchairs have become a more common solution for facilitating motion for affected persons, in particular persons suffering from more severe conditions. One type of powered wheelchairs is an electrically powered wheelchair. The power to an electrically powered wheelchair can for instance be provided by an electric motor. By providing electrical power to drive the wheelchair, the quality of life for severely affected people is particularly improved since less manual operation is required. Hence, travelling longer distances is less exhausting with an electrically powered wheelchair. An electrical power source in a powered wheelchair may also be employed for additional advanced operations and functions of the wheelchair.

Over time, the operation of the powered wheelchair has continuously been further developed and for this type of wheelchairs it has often been an aim to improve the freedom of movement for the user of the wheelchair while maintaining a high level of safety during use.

Powered wheelchairs may for instance be designed for indoor, outdoor or indoor/outdoor use. A powered wheelchair for outdoor use may preferably have a considerable range, i.e. a large wheelbase to help with stability, whilst a typical powered wheelchair for indoor use often is narrow and short, to enable better manoeuvring around tight environments.

In order to minimize the risk of forward or backward tipping during operation of the powered wheelchair, there is often provided one or several anti-tip supports or anti-tip support wheels. This type of means may typically be arranged at the rear or in front of the powered wheelchair and often positioned a few centimeters from the ground surface, e.g. the floor. The anti-tip supports or anti-tip support wheels may also be arranged on the powered wheelchair in order to improve the stability during operation of the powered wheelchair. Anti-tip supports or anti-tip support wheels may therefore be considered as valuable safety features of the powered wheelchair.

Yet, some anti-tip supports or anti-tip support wheels may be regarded as impediment by restricting the freedom of operation of the powered wheelchair. For this reason, many anti-tip wheels are removable, height adjustable or capable of being folded up by accompanying person such as carers.

Hence, it would be beneficial if it could be ensured that the stability of the powered wheelchair can be provided without excessive manual operations.

SUMMARY OF THE INVENTION

In view of the above-mentioned and other drawbacks of the prior art, a general object of the present invention is to provide a stable powered wheelchair, yet having a simple construction, which enables improved stability in particular when operated in an indoor environment. This and other objects, which will become apparent in the following, are accomplished by a powered wheelchair as defined in the accompanying independent claim. Preferred optional features are recited in the associated dependent claims.

According to a first aspect of the present invention, there is provided a powered wheelchair for transporting a person, comprising a seat frame for supporting the person and a pair of opposing main wheel assemblies, including a first main wheel assembly and a second main wheel assembly connected to the seat frame. The powered wheelchair further comprises a third main wheel assembly arranged spaced apart from the pair of opposing main wheel assemblies and connected to said seat frame. The first main wheel assembly is pivotable about a first pivot point $P_1$ to adjust a position of the first main wheel assembly and the third main wheel assembly is pivotable about a third pivot point $P_3$ to adjust a position of the third main wheel assembly. The powered wheelchair further comprises a support wheel arrangement for supporting the powered wheelchair. The support wheel arrangement includes a main beam and a front support wheel unit capable of being applied to a ground surface. Moreover, the main beam is rotatably connected to the third main wheel assembly at a third connection point $C_3$ and connected via a guiding mechanism to the first main wheel assembly at a first connection point $C_1$. In addition, the main beam has a first portion adapted to cooperate with the guiding mechanism when the first portion passes through a part of the guiding mechanism upon movement of the main beam relative to the guiding mechanism to maintain the support wheel arrangement in a supporting position S, in which the front support wheel unit is applied to the ground surface.

By the principle of the present invention, it becomes possible to provide a powered wheelchair that is capable of providing additional support in a situation when the powered wheelchair is operated in indoor mode, typically referring to a situation when the wheelbase of the powered wheelchair is short, in order to ensure a sufficient level of stability. Hereby, a more user-friendly and safer driving environment is provided for the user of the powered wheelchair.

In particular, by the configuration of the support wheel arrangement according to the present invention, it becomes possible to maintain the stability of the powered wheelchair upon an adjustment of the wheelbase. Accordingly, the present invention is particularly useful when the powered wheelchair includes means for changing the wheelbase of the powered wheelchair. This type of powered wheelchair often requires additional front support in order to prevent the wheelchair from tipping forward when the wheelbase is short.

The adjustment of the wheelbase of the powered wheelchair is provided by the provisions that the first main wheel assembly is pivotable about the first pivot point $P_1$ to adjust a position of the first main wheel assembly and the third main wheel assembly is pivotable about the third pivot point $P_3$ to adjust a position of the third main wheel assembly. Accordingly, the front support wheel unit can be maintained in the supporting position, via cooperation between the first portion and the guiding mechanism, when a wheelbase distance of the powered wheelchair is changed by an adjustment of the position of the first main wheel assembly and/or the position of the third main wheel assembly.

It is believed that the present invention is superior over previous prior art system in that a stable front support arrangement is provided without the need for any additional motors or actuators in direct connection to the support wheel arrangement. Instead, the present invention is realised by a simple construction of a main beam having a first portion being adapted to cooperate with a guiding mechanism when the main beam is moved relative to the guiding mechanism. In particular, an almost arbitrary motion of the front support wheel unit can be realised in relation to the changed wheelbase.

Moreover, the powered wheelchair may allow for a significant reduction in weight compared to many of the existing powered wheelchair since the front wheel support arrangement has a simple construction involving a minimum of components. Therefore, more traditional chassis can be eliminated. This may further have a positive impact on the costs of manufacturing powered wheelchairs.

As mentioned above, the "supporting position" refers to a state of the support wheel arrangement when the front support wheel unit is applied to the ground surface, which typically allows for better support when the powered wheelchair is operated in the indoor mode, i.e. having a relatively short wheelbase.

The term "guiding mechanism" is intended to include a means which is in the position to guide the movement of the main beam. More specifically, due to the configuration that the main beam passes through a part of the guiding mechanism (upon a movement of the main beam relative to the guiding mechanism), it becomes possible to ensure that the main beam follows a predetermined trajectory defined by the shape of the main beam and the configuration of the main beam to the wheel assemblies, and also to avoid that the main beam accidently becomes displaced from the guiding mechanism.

As mentioned above, the support wheel arrangement is maintained in the supporting position S via cooperation between the first portion of the main beam and the guiding mechanism when the first portion passes through a part of the guiding mechanism upon movement of the main beam relative to the guiding mechanism. As an example, the support wheel arrangement can be maintained so that a deviation between the front support wheel unit and the ideal floor level (typically corresponding to the ground surface) is within the range of +/−1.5 mm when moving the guiding mechanism from an aft region of the first portion to a fore region of the first position. Without being bound by any theory, it is believed that a deviation between the front support wheel unit and the ideal floor level of +/−1.5 mm here represents an acceptable level of the deviation in order to maintain the support wheel arrangement via the front support wheel unit in the supporting position S.

The movement of the main beam relative to the guiding mechanism may be effected by a movement of the guiding mechanism, while the main beam remains in an essentially non-moving position. Alternatively, the movement of the main beam relative to the guiding mechanism may be effected by a movement of the main beam, while the guiding mechanism remains in an essentially non-moving position. Alternatively, the movement of the main beam relative to the guiding mechanism may be effected by a movement of the main beam and a movement of the guiding mechanism.

Accordingly, the movement of the main beam relative to the guiding mechanism may be defined by a movement of the guiding mechanism between an aft region of the first portion and a fore region of the first position.

To this end, if the main beam is moved a distance relative the guiding mechanism, as defined by the distance between the aft region of the first portion and the fore region of the first position, the front support wheel unit travels a corresponding distance on the ground surface in the supporting position. That is, the travelling distance of the front support wheel unit in the supporting position here corresponds to the distance between the aft region (or aft position) and the fore region (or fore position).

The guiding mechanism can, as an example, be provided in the form of a first rotatable shaft and a second rotatable shaft. Hereby, the guiding mechanism is configured to steer (or guide) the movement of the main beam via the arrangement of the first rotatable shaft and the second rotatable shaft. To this end, the guiding mechanism defines a passage for the main beam, which here is provided by the space between the first rotatable shaft and the second rotatable shaft.

More specifically, due to the configuration that the first portion of the main beam passes through the guiding mechanism (upon a movement of the main beam relative to the guiding mechanism), i.e. passes in-between the first rotatable shaft and the second rotatable shaft, it becomes possible to ensure that the main beam follows its predetermined trajectory and also to avoid that the main beam accidently becomes displaced from the guiding mechanism. Thus, the arrangement of the guiding mechanism and the main beam, via the first portion of the main beam, according to the present inventive concept is capable of maintaining the support wheel arrangement in a supporting position S, in which the front support wheel unit is applied to the ground surface, when the first portion of the main beam passes through a part of the guiding mechanism upon a movement of the main beam relative to the guiding mechanism.

The first rotatable shaft and the second rotatable shaft may be actively rotatable by for instance an electric motor arrangement. Alternatively, the first rotatable shaft and the second rotatable shaft may be passively rotatable (via e.g. a set of bearings) upon a movement of the main beam. When the main beam passes through a part of the guiding mechanism, the main beam contacts the surfaces of the first rotatable shaft and the second rotatable shaft upon movement. Accordingly, in the context of the invention, the main beam is considered as connected to the first wheel assembly, which means that the main beam is to move over a surface of the guiding mechanism, while maintaining smooth continuous contact. To this end, a part of the main beam (e.g. the first portion) is capable of sliding on the surface of the guiding mechanism upon a movement of the main beam relative to the guiding mechanism via a movement of any one of the main wheel assemblies.

Hence, according to a least one exemplary embodiment, the guiding mechanism is provided in the form of a set of rotatable shafts, i.e. a first rotatable shaft and a second rotatable shaft. In this exemplary embodiment, the main beam (e.g. the first portion) is configured to pass through the guiding mechanism and in-between the first rotatable shaft and the second rotatable shaft upon a movement of the main beam relative to the guiding mechanism. Accordingly, the first rotatable shaft and the second rotatable shaft are rotatably connected to the first main wheel assembly.

In another example, the guiding mechanism may be provided a hook-shaped element connected to the first main wheel assembly via e.g. a first shaft extending in the transverse direction. The hook-shaped element is shaped so that an inner curved surface of the hook-shaped element defines a passage for the main beam. Accordingly, the hook-shaped element is configured to support the movement of the main beam so that the first portion of the main beam is capable of cooperating with the guiding mechanism. In other words, the main beam (e.g. the first portion) is capable of sliding on the inner curved surface of the hook-shaped element. The hook-shaped element is typically a curved or angular piece of metal or other hard substance.

The rotatable shaft may for instance be a suitable bearing arrangement, a simple rotatable bushing or any other plain bearing suitable for the purpose.

Typically, the first portion is a straight first portion as seen in an axial direction of the first portion. In this manner, the main beam can be produced in a simple yet cost efficient manner. In other words, the first portion extends uniformly in the axial direction of the first portion. However, it is also conceivable that the first portion of the main beam may be slightly curved in order to get a more precise deviation between the front support wheel unit and the ideal floor level. In this context, a more precise deviation refers to a deviation of less than +/−1.5 mm between the front support wheel unit and the ideal floor level.

Typically, the first portion has a longitudinal extension in an axial direction of the first portion as well as a circumferential extension.

According to at least one exemplary embodiment, the extension of the first portion in the axial direction may be defined by a length corresponding to the distance between the aft region and the fore region.

As mentioned above, the first main wheel assembly is pivotable about the first pivot point to adjust a position of the first main wheel assembly. More specifically, the first main wheel assembly is pivotable about the first pivot point to adjust a position of the first main wheel assembly, as seen in the longitudinal direction X of the powered wheelchair. Analogously, the second main wheel assembly is pivotable about a second pivot point to adjust a position of the second main wheel assembly, as seen in the longitudinal direction X of the powered wheelchair. Analogously, the third main wheel assembly is pivotable about the third pivot point to adjust a position of the third main wheel assembly, as seen in the longitudinal direction X of the powered wheelchair. To this end, the first main wheel assembly is pivotable about the first pivot point to adjust a position of the first main wheel assembly relative to the third main wheel assembly. Analogously, the third main wheel assembly is pivotable about a third pivot point to adjust a position of the third main wheel assembly relative to the first main wheel assembly.

The term "pivotable" typically refers to a pivotal arrangement by means of rotation mechanism such as a rotary actuator. Accordingly, each one of the wheel assembly is pivotable arranged by a rotation mechanism.

According to at least one exemplary embodiment, the main beam further has an arcuate shaped portion adapted to cooperate with the guiding mechanism when the arcuate shaped portion passes through a part of the guiding mechanism upon movement of the main beam relative to the guiding mechanism, causing the support wheel arrangement to move from the supporting position, in which said front support wheel unit is applied to the ground surface, to a non-supporting position, in which said front support wheel unit is in a raised configuration. In this manner, it becomes possible to move the front support wheel unit from a lower position to a higher position, as seen from the ground surface, in a simple and convenient manner, while ensuring that the support is only provided when required, e.g. in the indoor mode of the powered wheelchair. Hence, it becomes possible to adjust the front support wheel unit without any support from accompanying person or carers.

According to at least one exemplary embodiment, the arcuate shaped portion is curved in a vertical direction Z. In addition, or alternatively, the arcuate shaped portion may be curved in the transverse direction Y.

Accordingly, the arcuate shaped portion may have a curvature in more than one plane in order to enable movement of the support wheel unit in a direction mainly perpendicular to the driving direction D.

According to at least one exemplary embodiment, the movement of the main beam relative to the guiding mechanism is effected by an adjustment of the position of any one of the first main wheel assembly and the third main wheel arrangement. As an example, the movement of the main beam relative to the guiding mechanism is effected by a movement of the third main wheel assembly in a direction away from the first main wheel assembly. Alternatively, the movement of the main beam relative to the guiding mechanism is effected by a movement of the first main wheel assembly in a direction away from the third main wheel assembly. The direction typically refers to a direction opposite to a travelling direction of the powered wheelchair.

Typically, the position of the first main wheel assembly is changed by a pivotal motion of the first main wheel assembly about the first pivot point $P_1$. Analogously, the position of the third main wheel assembly is changed by a pivotal motion of the third main wheel assembly about the third pivot point $P_3$.

Typically, the support wheel unit has an axle and a rim rotatably supported on the axle, said rim being encircled by a tire.

According to at least one exemplary embodiment, the second main wheel assembly is pivotable about a second pivot point $P_2$ to adjust a position of the second main wheel assembly. In this embodiment, the support wheel arrangement is a first support wheel arrangement and the powered wheelchair further comprises a second support wheel arrangement for supporting the powered wheelchair. The second support wheel arrangement has a second main beam and a second front support wheel unit capable of being applied to the ground surface. In addition, the second main beam is rotatably connected to the third main wheel assembly at a fourth connection point $C_4$ and connected via a second guiding mechanism to the second main wheel assembly at a second connection point $C_2$. Moreover, the second main beam has a second main beam first portion adapted to cooperate with the second guiding mechanism when the second main beam first portion passes through a part of the second guiding mechanism upon movement of the second main beam relative to the second guiding mechanism, to maintain the second support wheel arrangement in a supporting position, in which the second front support wheel unit is applied to the ground surface.

Typically, the fourth connection point and the third connection point are arranged on opposite sides of the third main wheel assembly, as seen in a transverse direction Y.

The second main wheel assembly is pivotable about the second pivot point to adjust a position of the second main wheel assembly relative to the third main wheel assembly. Analogously, the third main wheel assembly is pivotable about a third pivot point to adjust a position of the third main wheel assembly relative to the second main wheel assembly.

According to at least one exemplary embodiment, the front support wheel unit is a caster wheel arrangement.

According to at least one exemplary embodiment, the first main wheel assembly includes a first driving wheel having a first rotation centre $R_1$. In addition, the first driving wheel is operatively connected to a first rotation mechanism via a first linkage member. In other words, the first drive assembly comprises the first driving wheel, the first rotation mechanism and the first linkage member. Analogously, the second main wheel assembly includes a second driving wheel having a second rotation centre $R_2$. In addition, the second driving wheel is operatively connected to a second rotation mechanism via a second linkage member. In other words, the second drive assembly comprises the second driving wheel, the second rotation mechanism and the second linkage member. Analogously, the third main wheel assembly includes a third rotatable wheel having a third rotation centre $R_3$. In addition, the third rotatable wheel is operatively connected to a third rotation mechanism via a third linkage member. In other words, the third wheel assembly comprises the third rotatable wheel, the third rotation mechanism and the third linkage member.

In the context of the present invention, the term "operatively connected" typically refers to a connection between the wheel and the rotation mechanism by means of the linkage member so that the position of the wheel (e.g. the first driving wheel) is changed upon rotation of the corresponding rotation mechanism (e.g. the first rotation mechanism).

According to at least one exemplary embodiment, any one of the first driving wheel assembly and the second driving wheel assembly includes a wheel hub motor.

Thus, according to at least one exemplary embodiment, the first main wheel assembly is a first drive main wheel assembly and the second main wheel assembly is a second drive main wheel assembly.

According to at least one exemplary embodiment, the third main wheel assembly is a rear main wheel assembly. In other words, the powered wheelchair includes a rear third main wheel assembly. According to at least one exemplary embodiment, the third main wheel assembly is a non-powered wheel assembly. According to at least one exemplary embodiment, the pair of opposing main wheel assemblies is a pair of opposing front drive main wheel assemblies. In other words, the powered wheelchair includes a first front drive main wheel assembly and a second front drive main wheel assembly.

By means of the rotation mechanism, as mentioned above, it becomes possible to provide a powered wheelchair that is capable of transforming shape and wheelbase upon a rotation of any one of the rotation mechanisms. More specifically, due to the arrangement that each one of the main wheel assemblies is separately connected to corresponding rotation mechanisms, it becomes possible to independently operate each one of the wheel assemblies in order to adjust the wheelbase of the powered wheelchair. To this end, the powered wheelchair is capable of providing an improved control function while enabling a transformation between various operational modes that alleviates the drawbacks of many conventional powered wheelchairs.

In addition, since the pair of opposing main wheel assemblies and the third main wheel assembly are connected to the seat frame, it becomes possible to adjust the position of the seat frame by adjusting the position of any one of the wheel assemblies. The position of a main wheel assembly is adjusted by pivoting the main wheel assembly about its corresponding pivot point by operating the rotation mechanism. Hereby, the powered wheelchair allows for a transformation between various modes and thereby improves the versatility of the wheelchair. More specifically, by the arrangement of the powered wheelchair, the transformation between various modes can be carried out without added complexity in mechanics. By the provisions that the first main wheel assembly is operatively connected to the first rotation mechanism via the first linkage member, the first rotation mechanism is operable to rotate the drive wheel assembly about the first pivot point, and that the third main wheel assembly is operatively connected to the third rotation mechanism via the third linkage member, the third rotation mechanism is operable to rotate the third main wheel assembly about the third pivot point, it becomes possible to operate and control the rotation of the first drive assembly independently of the third main wheel assembly. Analogously, it becomes possible to operate and control the rotation of the third main wheel assembly independently of the first drive assembly.

According to at least one exemplary embodiment relating to a powered wheelchair in which the three wheel assemblies are independently operable relative to each other, as described in further details below, any one of a first wheelbase, a second wheelbase and the central wheelbase can be adjusted by pivoting any one of the first main wheel assembly, the second main wheel assembly and the third main wheel assembly about corresponding pivot points. Typically, the wheelbase is adjusted via the rotation mechanism(s) to obtain a set of predetermined mode of the powered wheelchair, as will be described further hereinafter.

Accordingly, it should be readily understood that the first rotation mechanism and the third rotation mechanism may be independently operable to adjust the wheelbase. In the context of the present invention, it is to be noted that since the wheels of the powered wheelchair are typically in contact with a ground surface when any one of the rotation mechanisms are operated, at least during normal use of the wheelchair, an adjustment of the position of any one of the main wheel assemblies result in that the position (e.g. height) of the seat frame of the wheelchair is changed since the lengths of the linkage members (essentially defining the distance from the wheel to the seat frame) are constant.

In the context of the inventive concept, a "first wheelbase" distance, as defined by the distance between the first rotation centre of the first driving wheel and the third rotation centre of the third rotatable wheel, can be adjusted by pivoting any one of the first main wheel assembly and the third main wheel assembly about its corresponding pivot point, i.e. by pivoting the first main wheel assembly about the first pivot point and/or the third main wheel assembly about the third pivot point. As an example, the wheelbase will be shortened if the first main wheel assembly is rotated about the first pivot point in a direction towards the third rotatable wheel, while the supporting wheel assembly remains its position or rotates (about the third pivot point) in a direction towards the first main wheel assembly. Analogously, the wheelbase will be increased if the first main wheel assembly is rotated about the first pivot point in a direction away from the third rotatable wheel, while the third main wheel assembly remains its position or rotates in a direction away from the first main wheel assembly. It should be readily appreciated that the above example is only one of many examples of pivoting a wheel assembly about a pivot point and there are several other different possibilities to adjust the wheelbase of the powered wheelchair.

Similar to the situation with the first wheelbase distance, a "second wheelbase" distance, as defined by the distance between the second rotation centre of the second driving wheel and the third rotation centre of the third rotatable wheel, can be adjusted by pivoting any one of the second main wheel assembly and the third main wheel assembly about corresponding pivot points, i.e. by pivoting the second main wheel assembly about the second pivot point and/or the third main wheel assembly about the third pivot point. As an example, the wheelbase will be shortened if the second main wheel assembly is rotated about the second pivot point in a direction towards the third rotatable wheel, while the third main wheel assembly remains its position or rotates (about the third pivot point) in a direction towards the second main wheel assembly. Analogously, the wheelbase will be increased if the second main wheel assembly is rotated about the second pivot point in a direction away from the third rotatable wheel, while the third main wheel assembly remains its position or rotates in a direction away from the second main wheel assembly. It should be readily appreciated that the above example is only one of many examples of pivoting the wheel assembly about a pivot point and that there are several additional different possibilities to adjust the wheelbase of the powered wheelchair.

Accordingly, this type of powered wheelchair arrangement allows for adjusting any one of the first wheelbase and the second wheelbase as well as the central wheelbase. The central wheelbase may be adjusted by initially adjust the first wheelbase and thereafter the second wheelbase. However, it should also be readily appreciated that the first main wheel assembly and the second main wheel assembly may be simultaneously operated in an aligned manner via the first rotation mechanism and the second rotation mechanism, respectively. In this manner, the "central wheelbase" distance, here defined as the distance between a common axis of rotation of the first and second rotation centres and the third rotation centre of the third main wheel assembly, can be adjusted by pivoting any one of the first main wheel assembly, the second main wheel assembly and the third main wheel assembly about corresponding pivot points.

As mentioned above, the position of the seat frame can be adjusted upon an adjustment of the wheelbase (first, second and/or central wheelbase). Accordingly, it should be readily understood that the first rotation mechanism, the second rotation mechanism and the third rotation mechanism may be independently operable to adjust the wheelbase. In addition, the wheelbase can typically be adjusted via any one of the rotation mechanisms to obtain as set of predetermined mode of the powered wheelchair, as will be described further hereinafter.

In the context of the present invention, the travelling direction typically refers to the normal driving direction of the wheelchair.

As mentioned above, any one of the first rotation mechanism, the second rotation mechanism and the third rotation mechanism may be operable to adjust the wheelbase of the powered wheelchair. In a general definition, the wheelbase herein may refer to any one of the first, second and/or central wheelbases.

The wheelbase can be adjusted so that the powered wheelchair is capable of being transformed between several different modes. Typically, the powered wheelchair may be operated between an indoor mode, an outdoor mode and a stand-up mode. The indoor mode refers to powered wheelchair having a relatively short wheelbase, the outdoor mode refers to powered wheelchair having a relatively long wheelbase, while the stand-up mode refers to a mode in which the wheelchair is a "standing wheelchair" in the sense that seat frame supports the user in a nearly standing position. Accordingly, the powered wheelchair can be operated so that the user is allowed to sit or stand in the wheelchair as they wish.

Accordingly, the wheelbase may be shortened such that the powered wheelchair is in an indoor mode, where the pair of the opposing drive wheel assemblies is positioned in a mid section of the powered wheelchair, as seen in the travelling direction. The travelling direction here refers to the normal forward direction of the powered wheelchair, typically corresponding to the driving direction. In addition, or alternatively, the wheelbase may be increased such that the powered wheelchair is in an outdoor mode, where the pair of the opposing drive wheel assemblies is positioned in front of the seat frame of the powered wheelchair, as seen in the travelling direction.

According to at least one exemplary embodiment, the seat frame may include a first support section pivotably connected to a second support section, wherein the wheelbase is adjusted such that seat frame is positioned in a substantially vertical orientation (up-right position). In this manner, the powered wheelchair transforms into a stand-up mode. In other words, the stand-up mode here refers to a mode when the seat frame is in an essentially vertical orientation, as seen relative to the ground plane. As an example, the first support section is the back support section, while the second support section is the seat cushion support section.

According to at least one exemplary embodiment, the powered wheelchair may further comprise an accelerometer to operate any one of the first rotation mechanism, the second rotation mechanism and the third rotation mechanism. In addition, or alternatively, the powered wheelchair may further comprise a gyro to operate any one of the first rotation mechanism, the second rotation mechanism and the third rotation mechanism. In this manner, the powered wheelchair can be controlled (or operated) such that a levelled position of the seat frame is maintained regardless of terrain.

According to at least one exemplary embodiment, the powered wheelchair may further comprise a control unit for operating any one of the first main wheel assembly, the second main wheel assembly and the third main wheel assembly. Typically, the control unit is configured to operate any one of the first rotation mechanism, the second rotation mechanism and the third rotation mechanism. Optionally, although not strictly required, the control unit may be configured to independently operate any one of the first rotation mechanism, the second rotation mechanism and the third rotation mechanism, as mentioned above. In addition, or alternatively, the control unit may be configured to adjust the wheelbase of the powered wheelchair based on an operation of any one of the first rotary actuator, second rotary actuator and third rotary actuator.

The control unit may be a commercially available control unit already used in powered wheelchair. The term "control unit" may refer to a processing circuitry and/or may include a microprocessor, microcontroller, programmable digital signal processor or another programmable device. The control unit may also, or instead, include an application specific integrated circuit, a programmable gate array or programmable array logic, a programmable logic device, or a digital signal processor. Where the control unit includes a programmable device such as the microprocessor, microcontroller or programmable digital signal processor mentioned above, the processor may further include computer executable code that controls operation of the programmable device.

Typically, the third main wheel assembly may be adapted to turn in a way that aligns with the drive direction of the wheelchair. According to at least one exemplary embodiment, the third main wheel assembly is a caster wheel arrangement. A caster wheel arrangement is a wheel arrangement that is configured to turn in a way that aligns with the drive direction of the wheelchair. There are several different types of commercially available caster wheel arrangements. A caster wheel arrangement has a freedom of rotation such that the wheel is adapted to turn in a way that aligns with the drive direction of the wheelchair (or another device where the caster wheel is mounted) on the ground. For electrical wheelchairs, this is important for efficient turning control of the wheelchair.

In all exemplary embodiments of the present inventive concept, the rotation mechanism may be provided in the form of a rotary actuator. One example of a rotary actuator is a servo. Rotary actuators are commercially available and can be provided in many sizes and shapes.

The inventive concept can be used for various types of powered wheelchair. According to at least one exemplary embodiment, the powered wheelchair is an electrically powered wheelchair. An electrically powered wheelchair is a wheelchair that is moved via the means of an electric motor, rather than manual power. Typically, the electrically powered wheelchair further includes navigational controls, usually a small joystick mounted on an armrest of the seat frame.

Further features of, and advantages with, the present inventive concept will become apparent when studying the appended claims and the following description. The skilled person may realize that different features of the present inventive concept may be combined to create embodiments other than those described in the following, without departing from the scope of the present invention. For example, the above description of the different advantages of the present invention is primarily described in relation to an electrically powered wheelchair, however, the various embodiments of the inventive concept are of course also applicable when the powered wheelchair is driven by another type of power, such as a combustion engine.

In addition, the above description of the different advantages of the present invention is primarily described in relation to a powered wheelchair in which the drive assemblies are arranged in front of the rear third main wheel assembly, as seen in the travelling direction of the wheelchair, however, the various embodiments of the inventive concept are of course also applicable to a powered wheelchair in which the drive assemblies are arranged as rear drive assemblies and the third main wheel assembly is a front third main wheel assembly, as seen in the travelling direction of the wheelchair.

BRIEF DESCRIPTION OF THE DRAWINGS

The various aspects of the invention, including its particular features and advantages, will be readily understood from the following illustrative and non-limiting detailed description and the accompanying drawings, in which.

DETAILED DESCRIPTION OF EXEMPLARY EMBODIMENTS OF THE INVENTION

Figure 1A:
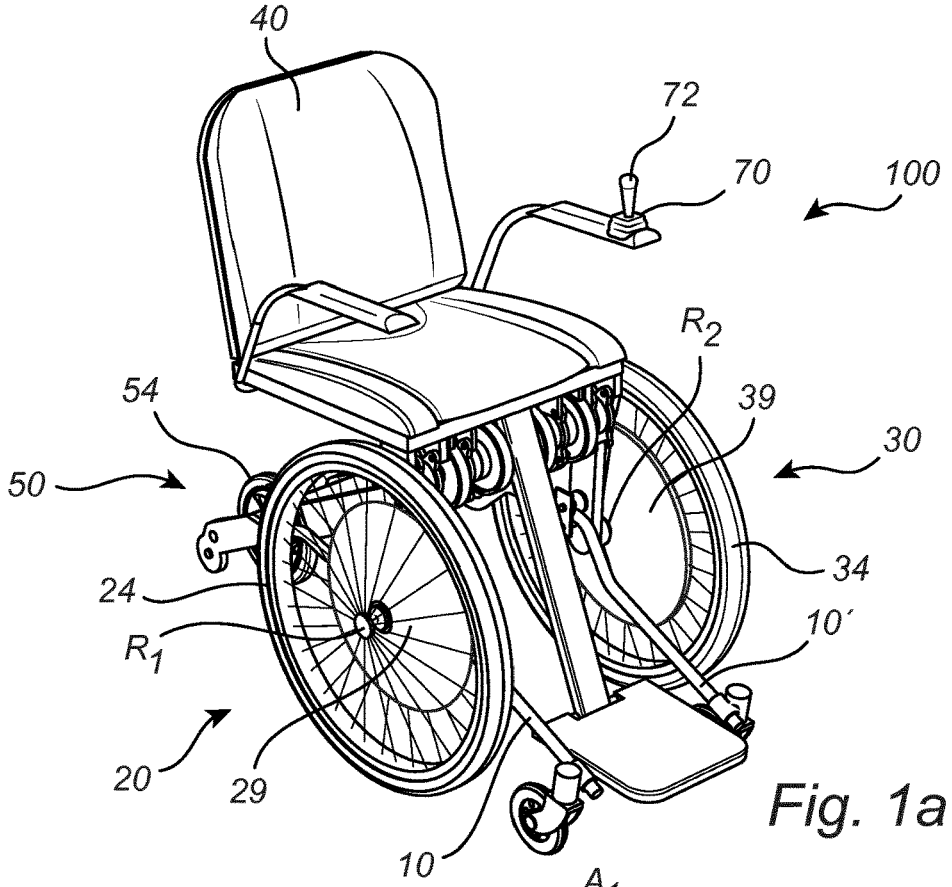
FIG. 1*a* illustrates schematically at least an exemplary embodiment of the present inventive concept.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout. Note that the directions in the following description are used for facilitating the understanding of a positional relation between components in the figures and that the directions may be different in other driving directions of the powered wheelchair. The same is applied to other exemplary embodiments described below.

Although the following description has been made to an electric-powered wheelchair, the present inventive concept may as well be implemented in other powered wheelchair. An electric-powered wheelchair refers to a wheelchair that is typically moved by the means of an electric motor, as further described herein.

The term "front" here corresponds to the front direction of the powered wheelchair, while the term "rear" here corresponds to the rear direction of the powered wheelchair. Analogously, when a part of the powered wheelchair is denoted with the term "front" or "rear", a reference may typically be made to the travelling direction (sometime also denoted the driving direction) when the wheelchair is driven in a forward direction to cause the wheelchair to move forwardly. However, it should be readily appreciated that the wheelchair may be driven in a reverse mode so that the wheelchair is driven in a direction (rearward direction) opposite to the normal travelling direction.

Figure 1B:
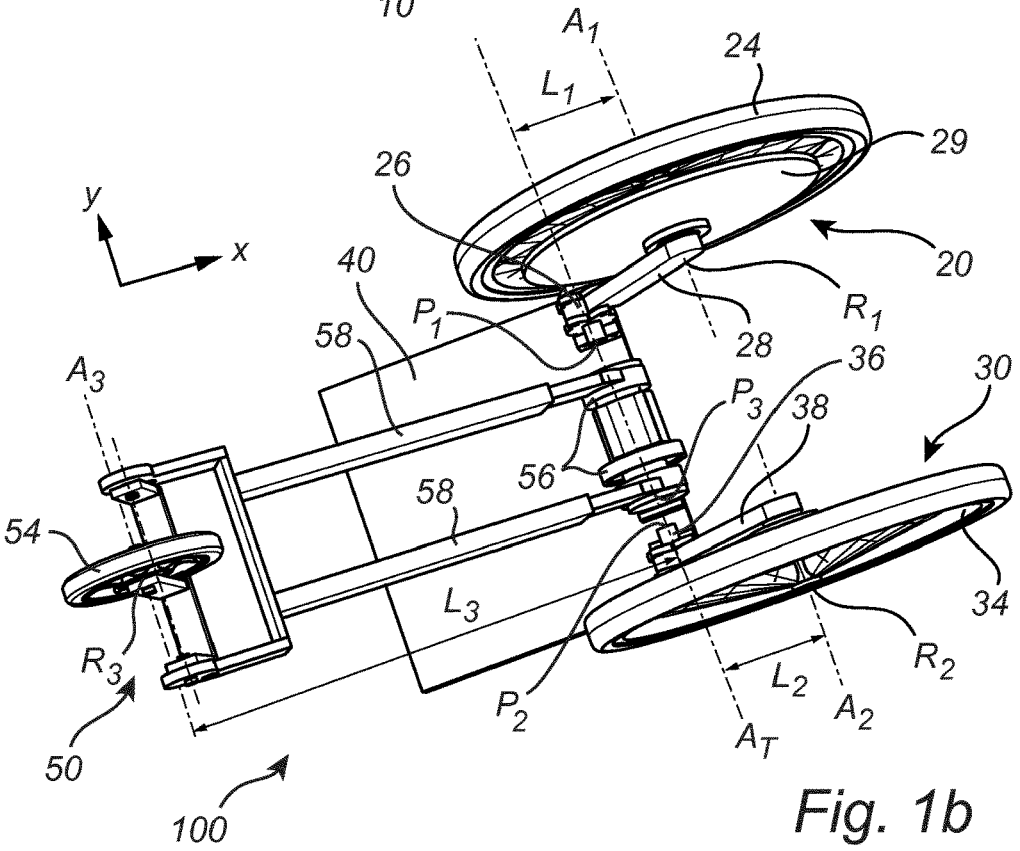
FIG. 1*b* is a bottom view of the exemplary embodiment of the present inventive concept in FIG. 1*a;*

Referring now to the drawings and to FIGS. 1*a* and 1*b* in particular, there is depicted an example of a powered wheelchair according to the present inventive concept. FIG. 1*a* illustrates schematically at least an exemplary embodiment of the present inventive concept. It should be noted that FIG. 1*a* is a general schematic representation of a powered wheelchair 100 for transporting a person and is merely intended to show an underlying principle of the inventive concept.

In this exemplary embodiment, the powered wheelchair 100 is illustrated as having a seat frame 40 for supporting the person, a pair of opposing main wheel assemblies 20, 30 configured to drive said powered wheelchair 100 and connected to the seat frame 40. The powered wheelchair further includes a third main wheel assembly 50 arranged spaced apart from the pair of opposing wheel assemblies 20, 30 and connected to the seat frame 40.

The pair of opposing main wheel assemblies 20, 30 includes a first main wheel assembly 20 and a second main wheel assembly 30, which will be described in more detail hereinafter with respect to FIG. 1*b*. The first drive assembly and the second drive assembly are arranged opposite each other as seen in a transverse direction Y of the powered wheelchair. Hence, the first drive assembly 20 and the second drive assembly 30 are spaced apart from each other, as illustrated in FIGS. 1*a* and 1*b*.

In addition, the pair of opposing main wheel assemblies 20, 30 is here configured to drive the powered wheelchair 100. Accordingly, the first main wheel assembly is here a first main drive wheel assembly. Analogously, the second main wheel assembly is here a second main drive wheel assembly.

In this exemplary embodiment, the third main wheel assembly 50 is further arranged spaced apart from the pair of opposing main wheel assemblies 20, 30 as seen in the transverse direction Y of the powered wheelchair 100, as illustrated in FIG. 1*b*. In addition, or alternatively, the third main wheel assembly 50 may be arranged spaced apart from the pair of opposing main wheel assemblies 20, 30 as seen in a longitudinal direction X of the powered wheelchair 100.

Turning now again to FIGS. 1*a* and 1*b*, it is illustrated a powered wheelchair 100 according to an exemplary embodiment of the inventive concept. As will be further described in detail herein, the first main wheel assembly 20 here includes a first driving wheel 24 having a first rotation centre $R_1$. In addition, the first driving wheel 24 is operatively connected to a first rotation mechanism 26 via a first linkage member 28, as shown in FIG. 1*b*. In other words, the first drive assembly comprises the first driving wheel 24, the first rotation mechanism 26 and the first linkage member 28. Analogously, the second main wheel assembly 30 here includes a second driving wheel 34 having a second rotation centre $R_2$. In addition, the second driving wheel 34 is operatively connected to a second rotation mechanism 36 via a second linkage member 38. In other words, the second drive assembly comprises the second driving wheel 34, the second rotation mechanism 36 and the second linkage member 38. Analogously, the third main wheel assembly 50 here includes a third rotatable wheel 54 having a third rotation centre $R_3$. In addition, the third rotatable wheel 54 is operatively connected to a third rotation mechanism 56 via a third linkage member 58. In other words, the third wheel assembly comprises the third rotatable wheel 54, the third rotation mechanism 56 and the third linkage member 58.

The first driving wheel 24 may further include an outer rim portion having a ground-facing surface for being in contact with the ground surface during use of the powered wheelchair. The rim portion may for instance be a circular metal structure around which a wheel tire is fitted. Analogously, the second driving wheel 34 may further include an outer rim portion having a ground-facing surface for being in contact with the ground surface during use of the wheelchair powered. Analogously, the third rotatable wheel 54 may further include an outer rim portion having a ground-facing surface for being in contact with the ground surface during use of the wheelchair powered.

The powered wheelchair 100 may be powered by an electric motor configured for driving the powered wheelchair via the pair of opposing main wheel assemblies 20, 30. As an example, the electric motor may be arranged within at least one of the driving wheels, e.g. in the form of a hub motor. Typically, but not strictly necessary, each one of the first driving wheel 24 and the second driving wheel 34 includes a wheel hub motor 29, 39, respectively. The wheel hub motor (also called wheel motor, wheel hub drive, hub motor or in-wheel motor) is an electric motor that is incorporated into the hub of a wheel and drives it directly. A wheel hub motor is beneficial in the sense that it may eliminate mechanical transmission including gearboxes, differentials, drive shafts and axles. Thereby, a significant weight and manufacturing cost saving may be realized. Accordingly, the first main wheel assembly 20 here includes a first wheel hub motor 29 configured to provide driving power to the powered wheelchair. Analogously, the second main wheel assembly 30 here includes a second wheel hub motor 39 configured to provide driving power to the powered wheelchair.

As shown in FIGS. 1*a* and 1*b*, the third main wheel assembly here is a rear main wheel assembly. In other words, the powered wheelchair includes a rear third main wheel assembly 50. It should thus be readily appreciated that throughout this description the component third main wheel assembly may sometimes be referred to as the third rear main wheel assembly without departing from the scope of the invention.

Further, the pair of opposing drive wheel assemblies is here a pair of opposing front drive main wheel assemblies. In other words, the powered wheelchair includes a first front main wheel assembly 20 and a second front main wheel assembly 30. It should thus be readily appreciated that throughout this description the component first main wheel assembly may sometimes be referred to as the first front main wheel assembly or first front main drive wheel assembly without departing from the scope of the invention. In addition, it should be readily appreciated that throughout this description the component second main wheel assembly may sometimes be referred to as the second front main wheel assembly or second front main drive wheel assembly without departing from the scope of the invention.

Typically, but not strictly necessary, the wheel diameter of the rear third rotatable wheel 54 is less than the wheel diameter of the front driving wheels 24, 34. As an example, the diameter of the rear third rotatable wheel is about 20 cm, and the diameter of a front driving wheel is about 50 cm.

Optionally, although not strictly necessarily, the powered wheelchair may include a leg or foot rest assembly as well as arm rests.

The powered wheelchair may further be provided with a control unit 70 for operating the powered wheelchair, as will be further described hereinafter. In order to facilitate the operation of the powered wheelchair, the control unit may include a user interface, such as a joystick 72.

The control unit may for example be arranged under the seat frame 40 or, as illustrated in FIG. 1*a*, adjacent to the user interface 72.

Moreover, the powered wheelchair 100, as shown e.g. in FIG. 1*a*, here includes a pair of support wheel arrangements 10, 10' for supporting the powered wheelchair. As will be described in more detail with respect to FIGS. 2*a* and 2*b*, each one of the support wheel arrangements includes a main beam 12 (12') and a front support wheel unit 14 (14') capable of being applied to a ground surface 95. The main beam is rotatably connected to the third main wheel assembly 50 at a third connection point $C_3$. Also, the main beam is further connected via a guiding mechanism 80 to the first main wheel assembly at a first connection point $C_1$.

Before turning to the arrangement and configuration of the front wheel support arrangement, further details of the arrangement and configuration of the first main wheel assembly, the second main wheel assembly and the third main wheel assembly will be described with reference to FIGS. 1*a* through 1*d*. Hence, for the sake of simplicity, the front wheel support arrangement is not illustrated in these figures. However, it should be readily appreciated that the exemplary embodiment in FIGS. 1*a* through 1*d* always is provided with a front wheel support wheel arrangement according to the present inventive concept.

As illustrated in FIG. 1*b*, which is a bottom view of the exemplary embodiment of the present inventive concept in FIG. 1*a*, the first main wheel assembly 20 includes the first driving wheel 24 having the first rotation centre $R_1$. The first rotation centre $R_1$ here corresponds to the first axis of rotation $A_1$ of the first driving wheel 24. The first driving wheel 24 is operatively connected to the first rotation mechanism 26 via the first linkage member 28. In other words, the first main wheel assembly comprises the first driving wheel 24, the first rotation mechanism 26 and the first linkage member 28. Moreover, the first rotation mechanism 26 is operable to rotate the first main wheel assembly 20 about the first pivot point $P_1$. Since the first driving wheel 24 is distanced from the rotation mechanism 26 by the first linkage member 28, the first rotation centre $R_1$ is offset from the first pivot point $P_1$.

Further, the first linkage member 28 is connected to the first driving wheel 24 in a manner that allows the first driving wheel 24 to rotate in a rolling fashion around the first rotation centre $R_1$. Typically, the first rotation centre $R_1$ corresponds to the first axis of rotation $A_1$. Hereby, the first driving wheel 24 is allowed to rotate around the first rotation centre $R_1$ upon a driving motion of the first wheel hub motor 29. The first linkage member 28 may be connected to the first driving wheel 24 via e.g. a bolt or similar. The connection may further include a bearing to support the rotational motion of the first driving wheel 24.

In this exemplary embodiment, the first rotation mechanism 26 is a rotary actuator. However, other options are conceivable as long as the rotation mechanism is capable to rotate the first main wheel assembly about the first pivot point.

As illustrated in FIGS. 1*a* and 1*b*, the first linkage member 28 here is rotatably connected to the first driving wheel 24 at the first rotation centre $R_1$ (or the first axis of rotation) on one side of the wheel 24. Alternatively, the first linkage member 28 may be rotatably connected at the first axis of rotation on both sides of the wheel, as long as the wheel is allowed to rotate about its rotation centre. If the first linkage member is connected on both sides of the wheel, the first linkage member may be formed as a fork reaching to both sides of the wheel at the first axis of rotation.

Analogous to the configuration of the first main wheel assembly, the third main wheel assembly 50 includes the third rotatable wheel 54 having the third rotation centre $R_3$. The third rotation centre $R_3$ here corresponds to a third axis of rotation $A_3$ of the third rotatable wheel 54. The third rotatable wheel 54 is operatively connected to the third rotation mechanism 56 via the third linkage member 58. In other words, the third main wheel assembly 50 comprises the third rotatable wheel 54, the third rotation mechanism 56 and the third linkage member 58. Moreover, the third rotation mechanism 56 is operable to rotate the third main wheel assembly 50 about the third pivot point $P_3$. Since the third rotatable wheel 54 is distanced from the third rotation mechanism 56 by the third linkage member 58, the third rotation centre $R_3$ is offset from the third pivot point $P_3$.

Further, the third linkage member 58 is connected to the third rotatable wheel 54 in a manner that allows the third rotatable wheel 54 to rotate in a rolling fashion around the third rotation centre $R_3$. Typically, the third rotation centre $R_3$ corresponds to the third axis of rotation $A_3$. Hereby, the third rotatable wheel 54 is allowed to rotate around the third rotation centre $R_3$. It should be noted that the third main wheel assembly 50 here is not directly connected to a drive source (such as an electric motor).

Instead, the third rotatable wheel 54 rotates on the basis of the driving motion from the first drive assembly and second drive assembly 20, 30. Accordingly, the third main wheel assembly 50 here is a non-powered wheel assembly. Thus, the third rotatable wheel 54 may roll without being provided with electric-power itself. In other words, the wheel 54 is allowed to freely rotate about the third axis of rotation $A_3$ as a response to a contact with the ground. To this end, the third main wheel assembly 50 is adapted to merely provide support and stability to the powered wheelchair 100. The third linkage member 58 may be connected to the wheel 54 via e.g. a bolt or similar. The connection may further include a bearing to support the rotational motion of the third rotatable wheel 54. In this exemplary embodiment, the third rotation mechanism 56 is a rotary actuator. However, other options are conceivable as long as the rotation mechanism is capable to rotate the third main wheel assembly 50 about the pivot point $P_3$. As illustrated in FIGS. 1*a* and 1*b*, the third linkage member 58 here is rotatably connected to the third rotatable wheel 54 at the third rotation centre $R_3$ (or the third axis of rotation) on both sides of the wheel 54. Alternatively, the third linkage member 58 may be rotatably connected at the third axis of rotation on only one side of the wheel, as long as the wheel is allowed to rotate about its rotation centre. If the third linkage member is connected on both sides of the wheel, the third linkage member may be formed as a fork reaching to both sides of the wheel at the first axis of rotation.

Typically, the third main wheel assembly 50 may be adapted to turn in a way that aligns with the driving direction of the wheelchair. Hence, although not strictly required, the third rotatable wheel may be a caster wheel arrangement. In the exemplary embodiment of FIGS. 1*a* and 1*b*, the powered wheelchair 100 here comprises a caster wheel arrangement. The caster wheel arrangement may comprise a caster wheel module and a caster wheel linkage member. The caster wheel arrangement may be operatively controlled by the control unit for controlling the position of the caster wheel module with respect to the ground and/or the chassis. For instance, the control unit can be configured to control the caster wheel module such that the caster wheel module is rotated about a caster wheel module axis of rotation in a direction towards the driving direction D of the wheelchair 100. The rotation of the caster wheel module provides improved control of the powered wheel chair when turning. In this manner, the caster wheel arrangement has a freedom of rotation such that the wheel is adapted to turn in a way that aligns with the driving (travelling) direction of the wheelchair on the ground. For electrical powered wheelchairs, this is important for efficient turning control of the wheelchair.

Analogous to the configuration of the first main wheel assembly, the second main wheel assembly 30 in the exemplary embodiment in FIGS. 1*a* and 1*b* includes the second driving wheel 34 having the second rotation centre $R_2$. The second rotation centre $R_2$ here corresponds to a second axis of rotation $A_2$ of the second driving wheel 34. The second driving wheel 34 is operatively connected to the second rotation mechanism 36 via the second linkage member 38. In other words, the second main wheel assembly 30 comprises the second driving wheel 34, the second rotation mechanism 36 and the second linkage member 38. Moreover, the second rotation mechanism 36 is operable to rotate the second main wheel assembly 30 about a second pivot point $P_2$. Since the second driving wheel 34 is distanced from the rotation mechanism 36 by the linkage member 38, the second rotation centre $R_2$ is offset from the second pivot point $P_2$.

Moreover, in this exemplary embodiment, as is evident from FIGS. 1*a* and 1*b*, the first rotation centre $R_1$, the second rotation centre $R_2$ and the third rotation centre $R_3$ are offset from each other. In other words, the first linkage member 28 has a length $L_1$ as seen in a longitudinal direction of the first linkage member 28. Analogously, the second linkage member 38 has a length $L_2$ as seen in a longitudinal direction of the second linkage member 38. Analogously, the third linkage member 58 has a length $L_3$ as seen in a longitudinal direction of the third linkage member 58.

By the above configuration of the second main wheel assembly 30, the second linkage member 38 is connected to the second driving wheel 34 in a manner that allows the second driving wheel 34 to rotate in a rolling fashion around the second rotation centre $R_2$. Typically, the second rotation centre $R_2$ corresponds to the second axis of rotation $A_2$. Hereby, the second driving wheel 34 is allowed to rotate around the second rotation centre $R_2$ upon a driving motion of a second wheel hub motor 39. The second linkage member 38 may be connected to the second driving wheel 34 via e.g. a bolt or similar. The connection may further include a bearing to support the rotational motion of the second driving wheel 34.

In this exemplary embodiment, the second rotation mechanism 36 is a rotary actuator. However, other options are conceivable as long as the rotation mechanism is capable to rotate the drive wheel assembly about the pivot point.

As illustrated in FIGS. 1*a* and 1*b*, the second linkage member 38 here is rotatably connected to the second driving wheel 34 at the second rotation centre $R_2$ (or the second axis of rotation) on one side of the wheel 34. Alternatively, the second linkage member 38 may be rotatably connected at the second axis of rotation on both sides of the wheel, as long as the wheel is allowed to rotate about its rotation centre. If the second linkage member is connected on both sides of the wheel, the second linkage member may be formed as a fork reaching to both sides of the wheel at the first axis of rotation.

As may be gleaned from FIGS. 1*a* and 1*b*, the first pivot point $P_1$, the second pivot point $P_2$ and the third pivot point $P_3$ are here offset in relation to each other. Optionally, although not strictly necessary, the first pivot point $P_1$, the second pivot point $P_2$ and the third pivot point $P_3$ are here offset from each other along a common transverse axis $A_T$, as seen in a direction essentially transverse to the longitudinal direction X of the wheelchair (typically corresponding to the travelling/driving direction D of the wheelchair). Hence, in this exemplary embodiment, the common transverse axis extends the transverse direction Y. Accordingly, by the provision that the third main wheel assembly is arranged spaced apart from the pair of opposing main wheel assemblies means that the first pivot point $P_1$, the second pivot point $P_2$ and the third pivot point $P_3$ are positioned offset in relation to each other.

Since the first pivot point $P_1$, the second pivot point $P_2$ and the third pivot point $P_3$ are spaced apart from each other, due to the offset as mentioned above, the pivot point arrangement allows for seat lift and tilt, variable wheelbase, as described herein, and automatic levelling of the seat frame 40.

In another exemplary embodiment (although not shown), the first pivot point $P_1$, the second pivot point $P_2$ and the third pivot point $P_3$ may be offset in relation to each other both in the traverse direction Y and the longitudinal direction X. However, the first pivot point $P_1$ and the second pivot point $P_2$ should typically be located along the common transverse axis $A_T$ so as to ensure that the pair of opposing main wheel assemblies 20, 30 can be operable and controlled simultaneously (i.e. synchronously) without compromising the driving function of the powered wheelchair.

Further, each rotation mechanism 26, 36, 56 of the powered wheelchair may be considered to form an interconnection between the seat frame and each corresponding linkage member 28, 38, 58. In other words, the rotation mechanisms 26, 36, 56 are arranged to the seat frame 40 at a first interconnection point, a second interconnection point and a third interconnection point, respectively.

In other words, each rotation mechanism is operable to rotate the corresponding linkage member and the corresponding wheel (first driving wheel, second driving wheel or third rotatable wheel) about the corresponding pivot point. Typically, although strictly not required, each corresponding rotation mechanism is in this exemplary embodiment arranged at each corresponding pivot point.

By rotating (or pivoting) a main wheel assembly about a pivot point, it becomes possible to adjust the position of the wheel of the wheel assembly. Hence, without being bound by any theory, the pivoting of the wheel assembly about the pivot point here corresponds to a pivoting of the wheel assembly about the transverse axis (extending in the transverse direction Y) and along a path in the longitudinal direction X. The longitudinal direction X typically corresponds to the travelling direction D of the wheelchair. In other words, the pivoting motion of a wheel assembly typically occurs in the longitudinal direction X.

Hence, as is illustrated in FIG. 1*b* and more specifically in FIGS. 3*a* through 5*b*, the first rotation mechanism 26 is operable to rotate the first wheel assembly 20 about a first pivot point $P_1$ along the longitudinal direction X of the powered wheelchair (typically considered as the driving direction D). In other words, the first main wheel assembly 20 is pivotable about the first pivot point $P_1$ to adjust a position of the first main wheel assembly. More specifically, the first main wheel assembly 20 is here pivotable about the first pivot point $P_1$ to adjust a position of the first main wheel assembly, as seen in the longitudinal direction X.

Analogously, the second rotation mechanism 36 is operable to rotate the second wheel assembly 30 about a second pivot point $P_2$ along the longitudinal direction X of the powered wheelchair (typically considered as the driving direction D). In other words, the second main wheel assembly 30 is pivotable about a second pivot point $P_2$ to adjust a position of the second main wheel assembly. More specifically, the second main wheel assembly 30 is pivotable about a second pivot point $P_2$ to adjust a position of the second main wheel assembly, as seen in the longitudinal direction X.

Analogously, the third rotation mechanism 56 is operable to rotate the third main wheel assembly 50 about a third pivot point $P_3$ along the longitudinal direction X of the powered wheelchair (typically considered as the driving direction D). In other words, the third main wheel assembly 50 is pivotable about the third pivot point $P_3$ to adjust a position of the third main wheel assembly. More specifically, the third main wheel assembly 50 is pivotable about a third pivot point $P_3$ to adjust a position of the third main wheel assembly, as seen in the longitudinal direction X.

Although each rotation mechanism allows for 360 degrees rotation of a main wheel assembly about its pivot point, the rotational motion of each wheel assembly is typically limited to rotate from a first position to a second position due to the arrangement and configuration of the inventive concept. Hence, each rotation mechanism is operable to rotate a corresponding wheel assembly about its corresponding pivot point between a first position and a second position. For instance, the rotational movement of each wheel assembly is limited by the location of the seat frame, as is evident from FIG. 1*a*. In addition, each wheel assembly here is typically configured to rotate from a first position to a second position by operating and controlling the rotation mechanism in an appropriate manner, e.g. by the control unit. The rotational movement of the main wheel assemblies will be further described hereinafter in 1*c* through FIG. 5*b*.

Due to above-mentioned arrangement and configuration of the wheel assemblies to the seat frame 40, each one of the wheel assemblies 20, 30, 50 is capable to be independently rotated upon operation of a corresponding rotation mechanism 26, 36, 56. More specifically, since each one of the wheel assemblies 20, 30, 50 is separately connected to a corresponding rotation mechanism 26, 36, 56, it becomes possible to independently operate each one of the wheel assemblies 20, 30, 50 in order to adjust the wheelbase of the powered wheelchair. In addition, since the rotation mechanisms 26, 36, 56 are connected to the seat frame 40, it becomes possible to adjust the position of the seat frame 40 by adjusting the wheelbase via operation of the rotation mechanisms 26, 36, 56.

Figure 1C:
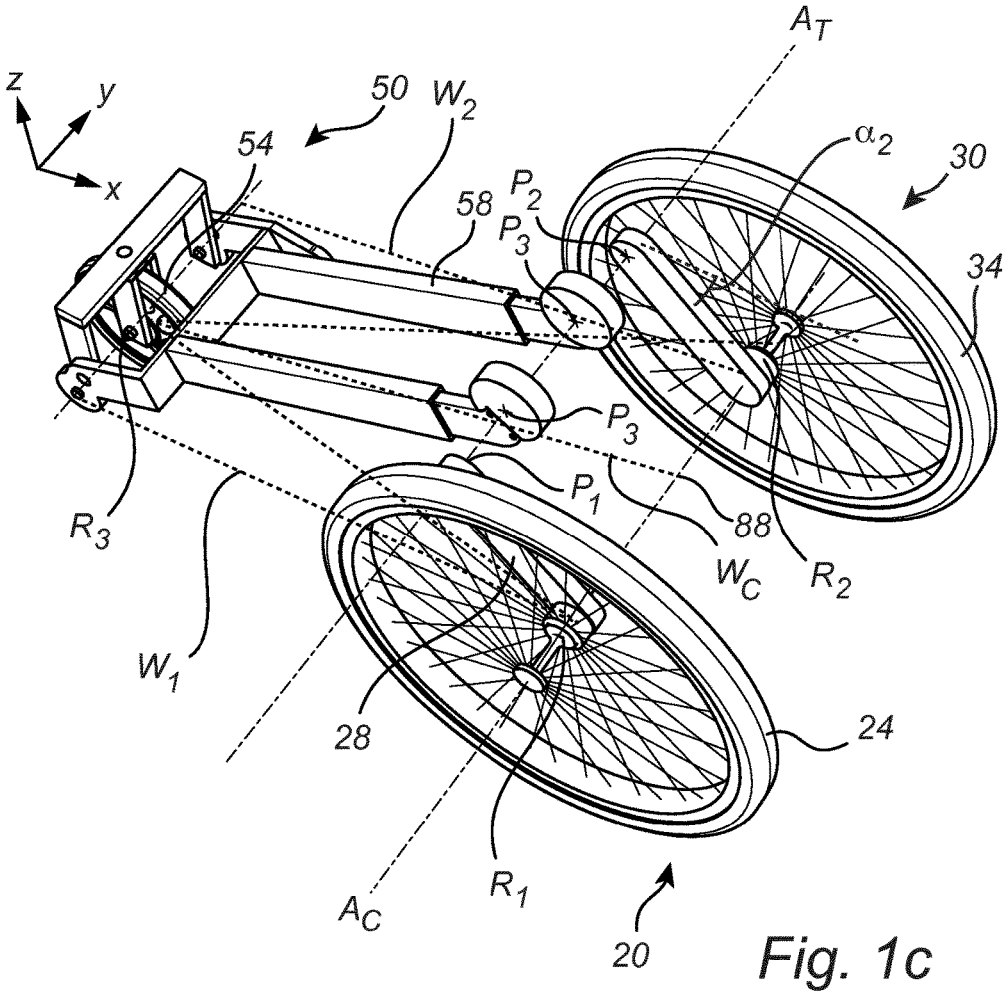
FIG. 1*c* illustrates a detailed view of the exemplary embodiment of the present inventive concept in FIG. 1*a;*

In the context of the present invention, and as illustrated in FIG. 1*c*, there are at least three different wheelbases $w_1$, $w_2$, $w_c$ that can be adjusted by operation of the rotation mechanisms 26, 36, 56.

As is evident from FIG. 1*c*, the first wheelbase distance $w_1$ is here defined by the distance between the first rotation centre $R_1$ of the first driving wheel 24 and the third rotation centre $R_3$ of the third rotatable wheel 54, as seen in the longitudinal direction X.

Analogously, the second wheelbase distance $w_2$ is here defined by the distance between the second rotation centre $R_2$ of the second driving wheel 34 and the third rotation centre $R_3$ of the third rotatable wheel 54, as seen in the longitudinal direction X.

Hence, the central wheelbase distance $w_c$ is here defined by the distance between a common axis of rotation $A_C$ of the first and second rotation centres $R_1$, $R_2$ and the third rotation centre $R_3$, as seen in the longitudinal direction X. The common axis of rotation $A_C$ here refers to an axis of rotation extending in the transverse direction Y. The first driving wheel 24 and the second driving wheel 34 have a common axis of rotation when the first rotation centre $R_1$ and the second rotation centre $R_2$ are aligned in the transverse direction Y upon a synchronous movement of the first and second main wheel assemblies 20, 30 along the longitudinal direction X of the powered wheelchair 100. In this situation, the first axis of rotation $A_1$ and the second axis of rotation $A_2$ in FIG. 1*b* are essentially concentric to the common axis of rotation $A_C$ of the first and second rotation centres $R_1$, $R_2$. In a situation when the first driving wheel 24 and the second driving wheel 34 may not have a common axis of rotation, the central wheelbase $w_c$ may be measured from a mid-point 88 of an imaginary line between the first rotation centre $R_1$ and the second rotation centre $R_2$, as seen in the transverse direction Y, to the third rotation centre $R_3$.

With reference to FIG. 1*c*, the first wheelbase distance $w_1$ can be adjusted by pivoting the first driving wheel 24 relative to the third rotatable wheel 54. In other words, the first wheelbase distance $w_1$ can be adjusted by pivoting the first main wheel assembly 20 relative to the third main wheel assembly 50. It is to be noted that any one of these two wheel assemblies may be pivoting relative to the other one of these two wheel assemblies to obtain an adjustment of the first wheelbase. Similarly, the second wheelbase distance $w_2$ can be adjusted by pivoting the second driving wheel 34 (and second main wheel assembly 30) relative to the third rotatable wheel 54 (and the third main wheel assembly 50). In other words, the second wheelbase distance $w_2$ can be adjusted by pivoting the second main wheel assembly 30 relative to the third main wheel assembly 50. It is to be noted that any one of these two wheel assemblies may be pivoting relative to the other one of these two wheel assemblies to obtain an adjustment of the second wheelbase.

Figure 1D:
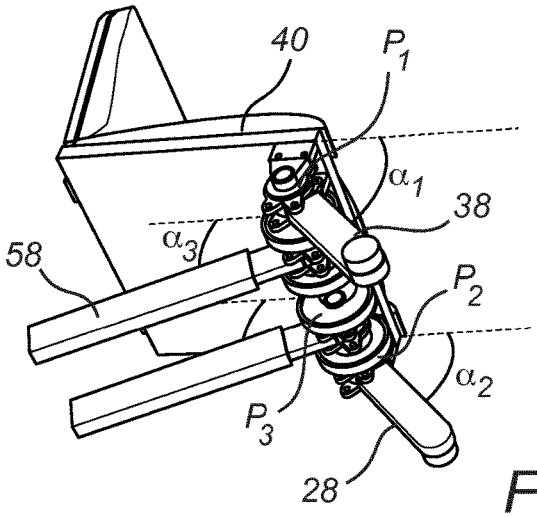
FIG. 1*d* is a side-view illustrating further details of the exemplary embodiment of the powered wheelchair in FIG. 1*a;*

A pivoting of a wheel assembly about its pivot point, which represents at least one of the functions of the rotation mechanism, can be further defined by a pivoting angle, as illustrated by $\alpha_2$ in FIG. 1*c*, and more particularly by $\alpha_1$, $\alpha_2$, $\alpha_3$ in FIG. 1*d*. Accordingly, the pivoting of the first main wheel assembly 20 about the first pivot point $P_1$ is here defined by a first pivoting angle $\alpha_1$, which in FIG. 1*d* corresponds to the angle $\alpha_1$ between the seat frame 40 and the first linkage member 28. Since the first main wheel assembly 20 is connected to the seat frame 40, it is evident that the permissible maximum pivoting angle typically ranges between 0 and 180 degrees. Accordingly, the first main wheel assembly 20 is pivoting in relation to the seat frame 40 by the first pivoting angle $\alpha_1$. In this exemplary embodiment, the pivoting is about a transverse axis of the wheelchair and along the longitudinal direction X of the wheelchair. In other words, the pivoting motion follows a path along a vertical plane of the wheelchair, the vertical plane extending in the longitudinal direction X and in a vertical direction Z. Typically, the vertical plane is perpendicular to the ground plane 95.

The pivoting of the second main wheel assembly 30 about the second pivot point $P_2$ is defined by a second pivoting angle $\alpha_2$, which in FIG. 1*d* corresponds to the angle $\alpha_2$ between the seat frame 40 and the second linkage member 38. Since the second main wheel assembly 30 is connected to the seat frame 40, it is evident that the permissible maximum pivoting angle typically ranges between 0 and 180 degrees. Accordingly, the second main wheel assembly 30 is pivoting in relation to the seat frame 40 by the second pivoting angle $\alpha_2$. Similar to the pivoting motion of the first drive assembly, the pivoting here is about a transverse axis of the wheelchair and along the longitudinal direction X of the wheelchair.

The pivoting of the third main wheel assembly 50 about the third pivot point $P_3$ is defined by a third pivoting angle $\alpha_3$, which in FIG. 1*d* corresponds to the angle $\alpha_3$ between the seat frame 40 and the third linkage member 58. Since the third main wheel assembly 50 here is connected to the seat frame 40, it is evident that the permissible maximum pivoting angle typically ranges between 0 and 180 degrees. Accordingly, the third main wheel assembly is pivoting in relation to the seat frame 40 by the third pivoting angle $\alpha_3$. Similar to the pivoting motion of the first drive assembly, the pivoting here is about a transverse axis of the wheelchair and along the longitudinal direction X of the wheelchair.

Figure 2A:
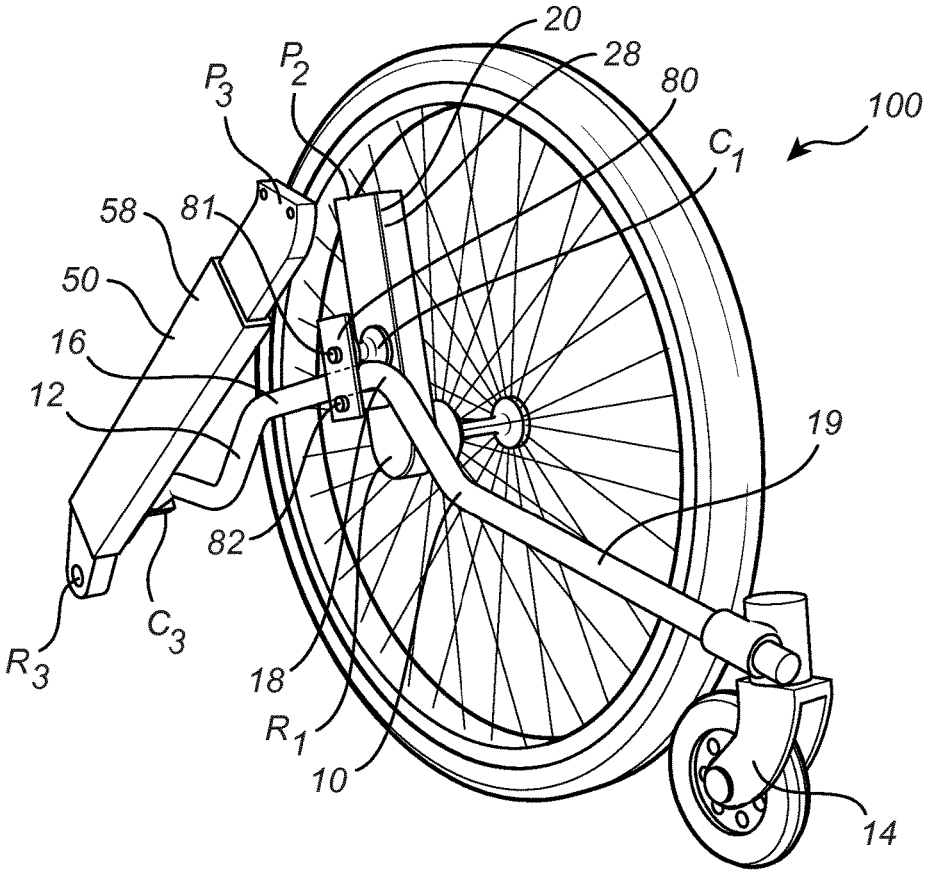
FIG. 2*a* is a perspective view illustrating a support wheel arrangement of an exemplary embodiment of the powered wheelchair.
Figure 2B:
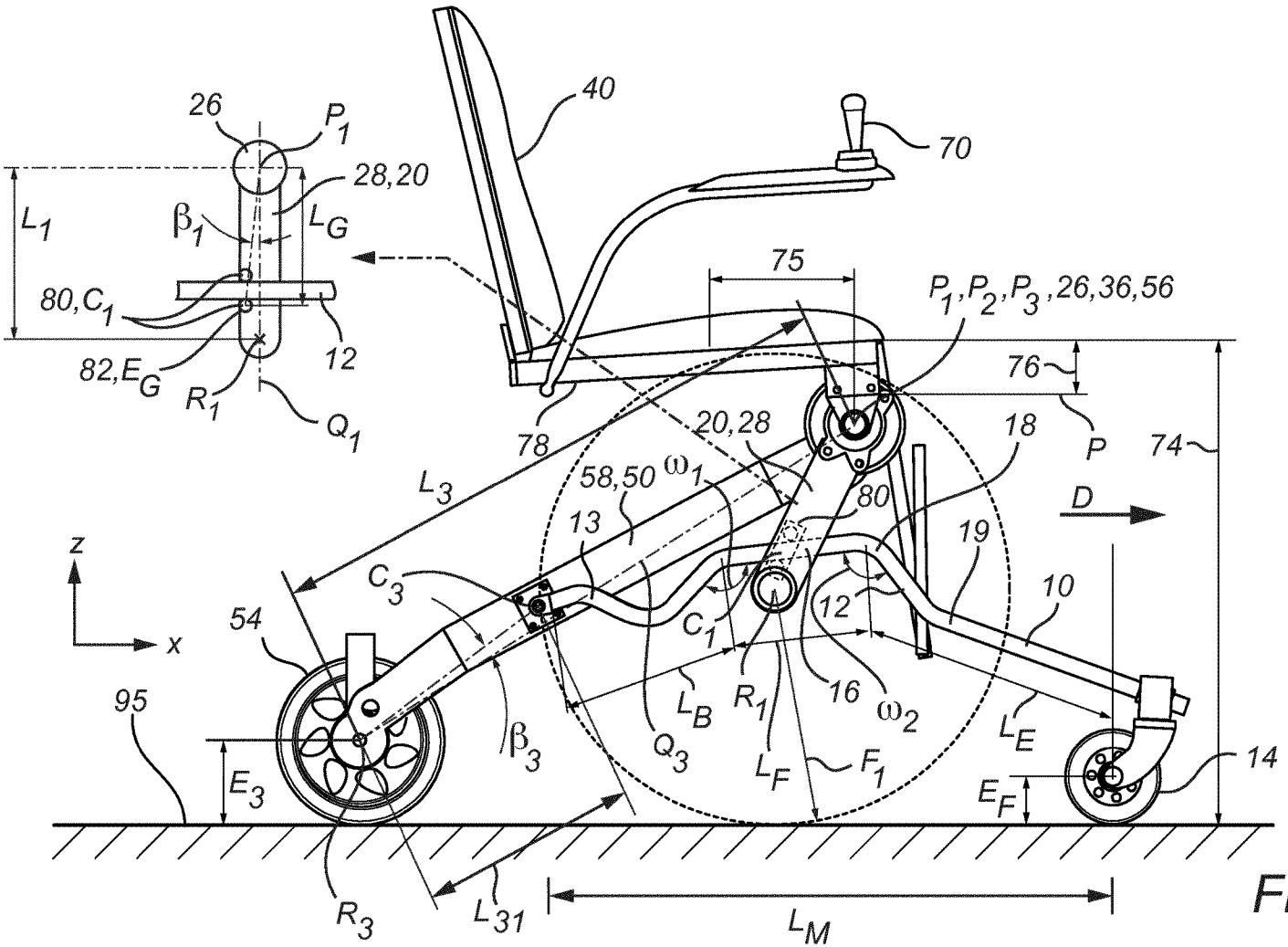
FIG. 2*b* is a side-view illustrating further details of a support wheel arrangement of an exemplary embodiment of the powered wheelchair in FIG. 2*a;*

As an example, the pivoting angles $\alpha_1$, $\alpha_2$, $\alpha_3$ may be between 10-150 degrees. Still preferably, the pivoting angles $\alpha_1$, $\alpha_2$, $\alpha_3$ may be between 30-135 degrees. Still preferably, the pivoting angles $\alpha_1$, $\alpha_2$, $\alpha_3$ may be between 45-110 degrees. It should be noted that the pivoting angles $\alpha_1$, $\alpha_2$, $\alpha_3$ are typically defined between the seat frame 40 and the relevant wheel assembly, but may be measured between an imaginary plane P (typically extending in the XY-plane) being parallel to the seat frame 40 and the relevant wheel assembly, as shown in FIG. 2*b*.

Advantages with this exemplary embodiment, as described above in relation to FIGS. 1*a* through 5*b*, are that the rotation of the first main wheel assembly 20 can be operated and controlled independently of the second main wheel assembly 30 and the third main wheel assembly 50, the rotation of the second main wheel assembly 30 can be operated and controlled independently of the first main wheel assembly 20 and the third main wheel assembly 50 and the rotation of the third main wheel assembly 50 can be operated and controlled independently of the first main wheel assembly 20 and second main wheel assembly 30.

As mentioned above, the powered wheelchair 100 according to at least one exemplary embodiment of the present inventive concept further includes the support wheel arrangement 10. FIG. 2*a* is a perspective view illustrating a support wheel arrangement of an exemplary embodiment of the powered wheelchair as described in relation to FIGS. 1*a* through 1*d*. In this exemplary embodiment, the support wheel arrangement is a forward-extending support wheel arrangement, i.e. it extends in the forward direction typically corresponding to the forward direction of the longitudinal direction X. As is shown in the various figures of the powered wheelchair, the support wheel arrangement 10 is suitable for supporting the powered wheelchair. More specifically, due to the arrangement of the support wheel arrangement 10, as described hereinafter, the support wheel arrangement is capable of supporting the powered wheelchair in a smooth and effective manner upon an adjustment of the wheelbase, for instance the central wheelbase distance, in order to provide support when the wheelchair is used in indoor areas, i.e. when the wheelchair is in an indoor mode. FIG. 2*a* illustrates a detailed view of the support wheel arrangement when it is connected to the first main wheel assembly 20 and rotatably connected to the third main wheel assembly 50, which are here represented by the first linkage member 28 and the third linkage member 58. As mentioned above with respect to FIGS. 1*a*-1*d*, the first main wheel assembly 20 is pivotable about the first pivot point $P_1$ to adjust a position of the first main wheel assembly 20, while the third main wheel assembly 50 is pivotable about the third pivot point $P_3$ to adjust a position of the third main wheel assembly 50.

As shown in at least FIG. 2*a*, the support wheel arrangement 10 has a main beam 12 and a front support wheel unit 14 capable of being applied to the ground surface 95. In addition, the main beam 12 is rotatably connected to the third main wheel assembly 50 at a third connection point $C_3$. Moreover, the main beam 12 is connected via a guiding mechanism 80 to the first main wheel assembly 20 at a first connection point $C_1$. The main beam 12 has a first portion 16 adapted to cooperate with the guiding mechanism 80 when said first portion 16 passes through a part of the guiding mechanism 80 upon movement of the main beam 12 relative to the guiding mechanism 80, to maintain said support wheel arrangement 10 in a supporting position S, in which the front support wheel unit 14 is applied to the ground surface 95.

As illustrated in FIG. 2*b* and FIGS. 3*a*-3*c*, the support wheel arrangement 10 here is maintained in the supporting position S via the front support wheel unit 14.

As shown in FIG. 2*a*, the main beam 12 here is connected via the guiding mechanism 80 to the first linkage member 28 of the first main wheel assembly 20. Advantageously, the main beam 12 is connected via the guiding mechanism 80 to the first linkage member 28 of the first main wheel assembly 20 at a distance from the first pivot point $P_1$.

Analogously, the main beam 12 here is rotatably connected to the third linkage member 58 of the third main wheel assembly 50. Advantageously, the main beam 12 is rotatably connected to the third linkage member 58 of the third main wheel assembly 50 at a distance from the third rotation centre $R_3$.

Typically, the front support wheel unit 14 has an axle and a rim rotatably supported on the axle. The rim may be encircled by a tire.

The third connection point provides for free rotation of the main beam around the connection point (i.e. around an essentially transverse axis). In this manner, the third connection point supports the rotational motion of the main beam. As an example, the main beam 12 can be rotatably connected to the third main wheel assembly 50 at a third connection point $C_3$ via a bearing. Hence, in this exemplary embodiment, the third connection point $C_3$ may include e.g. a bearing, a universal joint or any other suitable joint.

As mentioned above, the main beam 12 is also connected to the first wheel assembly 20 via the guiding mechanism 80 at the first connection point $C_1$. The guiding mechanism can be designed in several different ways as long as the guiding mechanism 80 can provide a connection to the first main wheel assembly 20, while enabling the first portion 16 of the main beam to pass through a part of the guiding mechanism 80 upon movement of the main beam 12 relative to the guiding mechanism 80. As shown in at least FIG. 2*a*, the guiding mechanism here includes a first rotatable shaft 81 and a second rotatable shaft 82. The first rotatable shaft 81 and the second rotatable shaft 82 here extends essentially in the transverse direction Y of the powered wheelchair. In addition, each one of the first rotatable shaft 81 and the second rotatable shaft 82 is typically provided with a bearing surface for supporting the movement of the main beam through the guiding mechanism 80. Thus, the first portion is arranged to move over a surface of at least one of the first rotatable shaft and the second rotatable shaft, while maintaining a smooth continuous contact.

In this example embodiment, the first rotatable shaft and the second rotatable shaft are rotatably connected to the first wheel assembly. In other words, by being rotatably connected to the first main wheel assembly, the first rotatable shaft 81 and the second rotatable shaft 82 rotate upon a movement of the main beam relative to the guiding mechanism 80. In this exemplary embodiment, the main beam passes through the guiding mechanism 80 in-between the first rotatable shaft 81 and the second rotatable shaft 82. Hence, the guiding mechanism is configured to support a movement of the main beam (relative to the guiding mechanism 80) by being rotatably connected to the first main wheel assembly. The guiding mechanism is arranged to the first main wheel assembly at the first connection point $C_1$. As mentioned above with respect to the third connection point, the first connection point provides for free rotation. In the example when the guiding mechanism includes a first rotatable shaft and a second rotatable shaft, the first connection point supports the rotational motion of the first rotatable shaft and the second rotatable shaft. As an example, the first rotatable shaft and the second rotatable shaft are rotatably connected to the first main wheel assembly 20 at the first connection point $C_1$ via one or several bearing(s). Hence, in this exemplary embodiment, the first connection point $C_1$ may include a bearing. To this end, the guiding mechanism is rotatably connected to the first main wheel assembly, e.g. rotatably connected to the first main wheel assembly via the bearing arrangement.

However, any one of the connection points may provide for free rotation in other ways, e.g. by a simple bushing etc.

Typically, although not strictly required, the main beam has a circular cross-section, as shown in FIG. 2*a*. In addition, the main beam has a longitudinal extension in an axial direction of the main beam as well as a circumferential extension.

As an example, the main beam can be made of a lightweight material such as stainless steel or aluminium.

As mentioned above, the support wheel arrangement 10 includes a main beam having a first portion 16 adapted to cooperate with the guiding mechanism 80 when the first portion 16 passes through a part of the guiding mechanism 80 upon movement of the main beam 12 relative to the guiding mechanism 80.

The first portion 16 may cooperate with the guiding mechanism in several different ways. Typically, although not strictly required, an outer surface of the first portion is cooperating with a surface of the guiding mechanism. As illustrated in FIG. 2*a*, and also in FIGS. 3*a* through 3*d*, the outer surface of the first portion is cooperating with an outer surface (bearing surface) of the first rotatable shaft 81 and an outer surface (bearing surface) of the second rotatable shaft 81 when the first portion passes through a portion of the guiding mechanism 80.

Hence, the first portion here is provided with an outer surface adapted to interact with a surface of the guiding mechanism.

Since the first portion has a longitudinal extension in an axial direction of the first portion (main beam) as well as a circumferential extension, the outer surface of the first portion extends in the longitudinal direction and in the circumferential direction. The first portion may further have an annular cross-section. In this example embodiment, the first portion is a tube portion. Accordingly, as shown in FIG. 2*b*, the first portion has a length $L_F$ in the axial direction of the first portion. The extension of the first portion in the axial direction, i.e. the length $L_F$, here also essentially corresponds to the distance between an aft region of first portion and a fore region of the first portion.

As may be gleaned from FIG. 2*a*, the guiding mechanism is here configured to steer or guide the movement of the main beam 12 via the arrangement of the first rotatable shaft 81 and the second rotatable shaft 82. More specifically, due to the configuration that the main beam passes through the guiding mechanism (upon a movement of the main beam 12 relative to the guiding mechanism 80), i.e. passes in-between the first rotatable shaft and the second rotatable shaft, it becomes possible to ensure that main beam 12 follows its predetermined trajectory and also avoid that the main beam accidently becomes displaced from the guiding mechanism 80.

To this end, the guiding mechanism 80 defines a passage for the main beam.

Thus, the arrangement of the guiding mechanism and the main beam, via the first portion of the main beam, according to the present inventive concept is capable of maintaining the support wheel arrangement 10 in a supporting position S, in which the front support wheel unit is applied to the ground surface 95, when the first portion of the main beam passes through a part of the guiding mechanism 80 upon a movement of the main beam 12 relative to the guiding mechanism 80.

Hence, if the main beam is moved a distance relative to the guiding mechanism, as defined by the distance between an aft region of the first portion and a fore region of the first position, the front support wheel unit travels a corresponding distance on the ground surface in the supporting position. That is, the travelling distance of the front support wheel unit in the supporting position here corresponds to the distance between the aft region (or aft position) and the fore region (or fore position).

Optionally, a main beam bridging portion 13 (also simply denoted bridging portion) may extend between the first portion 16 and the connection point $C_3$, as shown in e.g. FIG. 2*b*. One reason for extending the main beam with a bridging portion to the connection point $C_3$ is to provide an improved design of the main beam for a given powered wheelchair design. The bridging portion also contributes to arrange the first portion of the main beam at a desired distance from the ground surface 95 and the connection point $C_3$. In the configuration when the main beam includes a bridging portion, the bridging portion further provides the connection between the main beam and the connection point $C_3$.

The bridging portion 13 may be provided in the form of a straight main beam element. Alternatively, the bridging portion may include one or several curvatures in more than one plane. As an example, the bridging portion may be shaped in the form of the letter "Z".

Optionally, and as illustrated in FIGS. 2*a* and 2*b*, the main beam 12 is further provided with an arcuate shaped portion 18 adapted to cooperate with the guiding mechanism 80 when the arcuate shaped portion 18 passes through a part of the guiding mechanism 80 upon movement of the main beam 12 relative to the guiding mechanism 80, causing said support wheel arrangement 10 to move from the supporting position S, in which the front support wheel unit is applied to the ground surface 95, to a non-supporting position NS, in which the front support wheel unit 14 is in a raised configuration. That is, the term "non-supporting position" typically refers to the situation when the front support wheel unit is positioned above the ground surface and therefore not capable of providing support to the powered wheelchair during normal operation of the powered wheelchair. In this non-supporting position, the front support wheel unit is positioned above the surface 95. As is readily appreciated from the Figures, in particular FIGS. 2*a* and 3*d*, the design and curvature of the arcuate shaped portion ultimately defines the distance between the ground surface 95 and the front support wheel unit 14 when the front support wheel unit 14 is in its non-supporting position NS since the main beam will be lifted in accordance with the curvature and length of the arcuate shaped portion 18.

Typically, the arcuate shaped portion cooperates with the guiding mechanism via an outer surface. Hence, the arcuate shaped portion 18 here is provided with an outer surface adapted to interact with a surface of the guiding mechanism 80 (similar to the outer surface of the first portion 16).

As illustrated in FIGS. 2*a* and 2*b*, the arcuate shaped portion 18 is positioned in front of the first position 16, as seen in the longitudinal direction X of the powered wheelchair. Hence, the arcuate shaped portion 18 is typically positioned in front of the first position 16, as seen in the forward travelling direction D of the powered wheelchair.

Also the arcuate shaped portion 18 may have a curvature in more than one plane (although not shown) in order to enable movement of the support wheel unit in a direction mainly perpendicular to the driving direction D. In this configuration, the joint at C3 may typically be provided in the form of a universal joint type (or similar) so as to support rotation in more than one direction.

Optionally, a main beam front end bridging portion 19 (also simply denoted front end bridging portion) may extend between the arcuate shaped portion 18 and the front support wheel unit 14. One reason for extending the main beam with a front end bridging portion to the front support wheel unit 14 is to provide an improved design of the main beam for a given powered wheelchair design. The front end bridging portion 19 also contributes to arrange the front support wheel unit 14 at a desired distance at the front of the powered wheelchair.

In a configuration when the main beam is provided without the arcuate shaped portion, the front end bridging portion 19 extends between the first portion 16 and the front support wheel unit 14.

Analogous to the design of the bridging portion 13, the front end bridging portion 19 may be provided in the form of a straight main beam element. Alternatively, the front end bridging portion 19 may include one or several curvatures, as shown in FIG. 2*a*. As an example, the end bridging portion may be shaped in the form of the letter "Z".

As illustrated in FIGS. 2*a* and 2*b*, the front end bridging portion 19 is positioned in front of the arcuate shaped portion 18, as seen in the longitudinal direction X of the powered wheelchair. Hence, the front end bridging portion 19 is typically positioned in front of the arcuate shaped portion 18, as seen in the forward travelling direction D of the powered wheelchair. Further, in this exemplary embodiment of the inventive concept, the front end bridging portion 19 is the foremost portion of the main beam 12.

From the description above, it is also realized that the first portion 16 is positioned behind the arcuate shaped portion 18 and the front end bridging portion 19, as seen in the longitudinal direction X, typically corresponding to the forward travelling direction D of the powered wheelchair. Accordingly, the first portion 16 is a mid portion of the main beam 12. Analogously, the arcuate shaped portion 18 may also be considered a mid portion of the main beam 12.

Moreover, the front end bridging portion generally extends along a second longitudinal axis, wherein the direction of the second longitudinal axis being angled relative to direction of first longitudinal axis through the arcuate shaped portion. In other words, the first portion is spaced a distance from the front end bridging portion by the arcuate shaped portion.

The movement of the main beam 12 relative to the guiding mechanism 80 will now be described with particular reference to the arrangement of the wheel assemblies as mentioned above. Since the first main wheel assembly 20 is pivotable about the first pivot point $P_1$ to adjust a position of the first main wheel assembly and the third main wheel assembly 50 is pivotable about the third pivot point $P_3$ to adjust a position of the third main wheel assembly, as mentioned above, a movement of the main beam relative to the guiding mechanism 80 can be effected by an adjustment of the position of any one of the first main wheel assembly and the third main wheel arrangement. Accordingly, it is not strictly necessary that the main beam 12 itself moves since a movement of the main beam 12 relative to the guiding mechanism 80 can be effected merely by a movement of the guiding mechanism via an adjustment of the first main wheel assembly, and without a movement of the third main wheel assembly, as is further described hereinafter.

More specifically, since the position of any one of the first main wheel assembly 20 and the third main wheel assembly 50 is changed by a pivotal motion of the first main wheel assembly about the first pivot point $P_1$ and/or a pivotal movement of the third main wheel assembly 50 about the third pivot point $P_3$, a movement of the main beam 12 relative to the guiding mechanism 80 is effected by pivoting any one of the first main wheel assembly 20 about the first pivot point and the third main wheel assembly 50 about the third pivot point.

As an example, the movement of the main beam 12 relative to the guiding mechanism 80 can be effected by a movement of the third main wheel assembly 50 in a direction away from the first main wheel assembly 20. Typically, a direction away from the first main wheel assembly refers to a direction opposite to the travelling direction D of the powered wheelchair.

In addition, or alternatively, the movement of the main beam 12 relative to the guiding mechanism 80 can be effected by a movement of the first main wheel assembly 20 in a direction away from the third main wheel assembly 50. In other words, the first main wheel assembly 20 moves towards the front of the powered wheelchair 100, i.e. in the forward direction, as seen in the longitudinal direction X of the powered wheelchair. Accordingly, the wheelbase distance, as defined above, is adjusted via a rotation of any one of the wheel assemblies.

In a situation when the first main wheel assembly moves towards the front of the powered wheelchair, as seen in the longitudinal direction (i.e. the first main wheel assembly moves in a forward direction as seen in the longitudinal direction X), while the position of the third wheel assembly is maintained, the wheelbase distance will increase due to the movement of the first main wheel assembly relative to the third wheel assembly. In this manner, and since the main beam is rotatably connected to the third wheel assembly and connected to the first wheel assembly, the first portion 16 of the main beam will pass through the guiding mechanism 80 and cooperate with the guiding mechanism to maintain the support wheel arrangement in the supporting position S.

As should be readily understood from FIG. 2*a*, the first portion 16 of the main beam is capable to cooperate with the guiding mechanism to maintain the support wheel arrangement in the supporting position S along the entire length $L_F$ of the first portion 16. Hence, the front support wheel unit 14 follows the ground surface 95 as long as the first portion 16 cooperates with the guiding mechanism 80 due to the shape and the configuration of the main beam.

To this end, the main beam 12 is capable of sliding on the surface of the second rotatable shaft 82 upon a movement of the main beam 12 relative to the guiding mechanism 80 via a movement of any one of the main wheel assemblies.

In FIG. 2*a*, only one single support wheel arrangement of the powered wheelchair is shown. However, it will be appreciated that a second support wheel arrangement can also be present at the other side of the powered wheelchair in order to support the powered wheelchair, as shown in e.g. FIG. 1*a* and FIG. 4*a*-4*b*. Accordingly, the support wheel arrangement 10 may hereafter be denoted as the first support wheel arrangement 10. Optionally, the second support wheel arrangement may include all features, functions and effects as described with respect to the (first) support wheel arrangement 10.

However, one difference between the configuration of the second support wheel arrangement and the first support wheel arrangement 10 is that the second support wheel arrangement is rotatably connected to the third main wheel assembly 50 and connected via a second guiding mechanism 80' to the second main wheel assembly 30. As mentioned above, the second main wheel assembly 30 is pivotable about a second pivot point $P_2$ to adjust a position of the second main wheel assembly.

In addition, the support wheel arrangement 10 is a first support wheel arrangement 10.

More specifically, besides the first support wheel arrangement 10, the powered wheelchair 100, as illustrated by the exemplary embodiments in FIGS. 1*a* to 5*b*, optionally comprises the second support wheel arrangement 10' for supporting the powered wheelchair. The second support wheel arrangement 10' has a second main beam 12' and a second front support wheel unit 14' capable of being applied to the ground surface 95. Moreover, the second main beam 12' is rotatably connected to said third main wheel assembly at a fourth connection point $C_4$ and connected via a second guiding mechanism 80' to the second main wheel assembly at a second connection point $C_2$. The second main beam 12' has a first portion 16' adapted to cooperate with the second guiding mechanism 80' when the first portion 16' passes through a part of the second guiding mechanism 80' upon movement of the second main beam 12' relative to the guiding mechanism 80', to maintain the second support wheel arrangement 10' in a supporting position S', in which the second front support wheel unit 14' is applied to the ground surface 95.

Figure 4A:
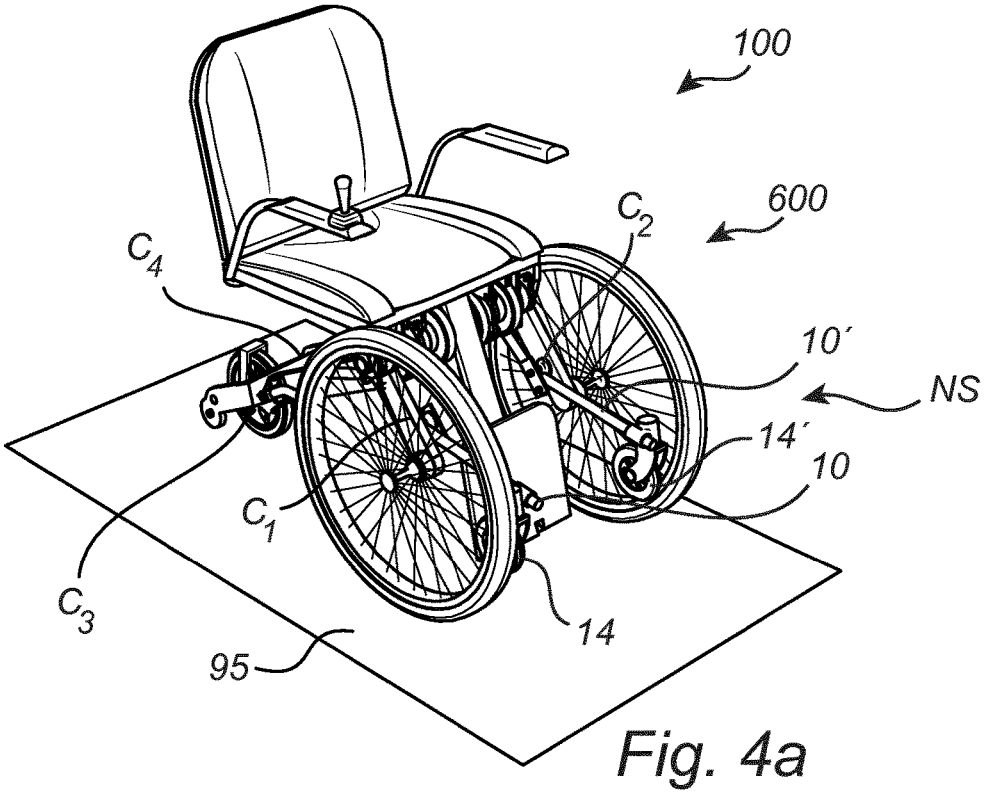
FIG. 4*a* is a perspective view illustrating an exemplary embodiment of the powered wheelchair in an outdoor mode, in which the support wheel arrangement is in a non-supporting position.
Figure 4B:
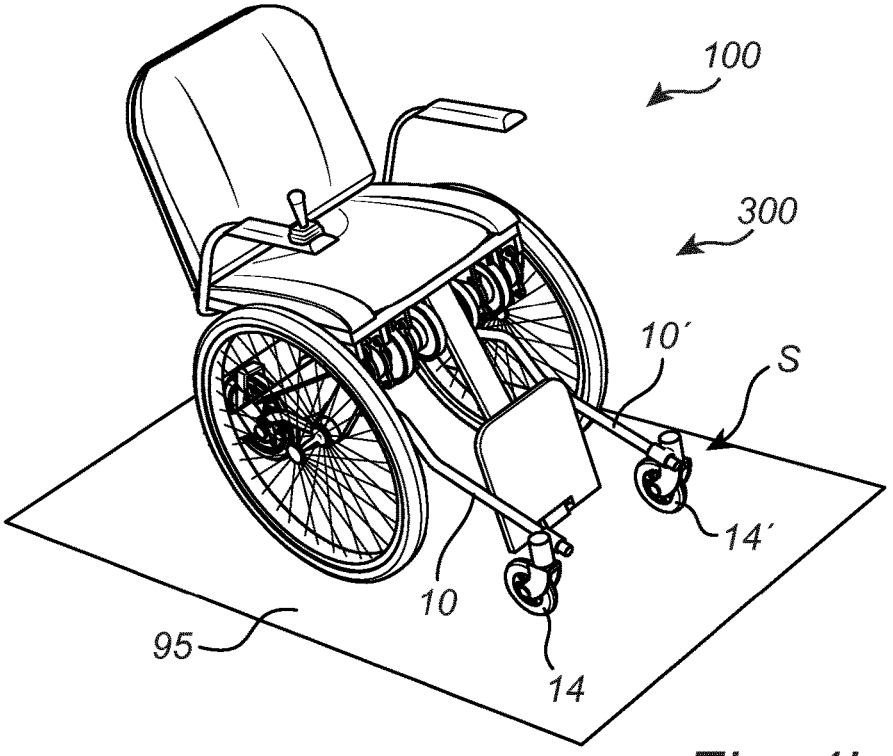
FIG. 4*b* is a perspective view illustrating an exemplary embodiment of the powered wheelchair in an indoor mode, in which the support wheel arrangement is in a supporting position.

As may be gleaned from FIG. 1*a* or FIGS. 4*a*-4*b*, the fourth connection point $C_4$ and the third connection point $C_3$ are typically arranged on opposite sides of the third main wheel assembly 50, as seen in a transverse direction Y.

In all exemplary embodiments of the inventive concept, a connection point may for instance include a bearing arrangement for supporting the rotational motion of the main beam about the connection point.

Although the shapes and lengths of the component of the present inventive concept may vary depending on the ultimate design of the powered wheelchair and the support wheel arrangement, one specific example of the geometries of the inventive concept is described hereinafter with particular reference to FIG. 2*b* in order to facilitate the understanding of the arrangement of the powered wheelchair. However, it should be readily appreciated that there are several different possibilities to design the front wheel arrangement and the powered wheelchair in order to provide the technical effects of the inventive concept as described herein.

Turning now to FIG. 2*b*, which is a side-view illustrating further details of the support wheel arrangement 10 (or 10') of an exemplary embodiment of the powered wheelchair in FIG. 2*a*, there is depicted the geometries of one possible configuration of a powered wheelchair having a support wheel arrangement in accordance with the present inventive concept.

In this exemplary embodiment, the pivot points $P_1$, $P_2$ and $P_3$ are arranged along the same common transverse axis $A_T$, as seen in the transverse direction Y.

As illustrated in FIG. 2*b*, the main beam has a length $L_M$. In addition, the first portion 16 has the length $L_F$, the bridging portion 13 has a length $L_B$ and the front end bridging portion 19 has a length $L_E$.

In the exemplary embodiment in FIG. 2*b*, the length $L_F$ of the first portion is 500 mm, the length $L_B$ of the bridging portion is 300 mm, and the length $L_E$ of the front end bridging portion 19 is 350 mm.

In addition, in FIG. 2*b*, an angle $\omega_1$ (omega 1) is defined as the angle between the first portion 16 and the front end bridging portion 19. The angle $\omega_1$ (omega 1) between the first portion 16 and the front end bridging portion 19 is in this exemplary embodiment 120 degrees. In addition, the angle $\beta_1$ here corresponds to the magnitude of the curvature of the arcuate shaped portion 18. Hence, as an example, the curvature of the arcuate shaped portion may be 120 degrees, and defined as shown in FIG. 2*b*.

An angle $\omega_2$ (omega 2) is defined between the first portion 16 and the bridging portion 13. The angle $\omega_2$ (omega 2) between the first portion 16 and the bridging portion 13 is in this exemplary embodiment 135 degrees.

As is further illustrated in FIG. 2*b*, the connection point $C_3$ is arranged slightly offset from a centre axis $Q_3$ of the third linkage member 58. Accordingly, an offset angle $\beta_3$ (beta 3) is defined between the line $Q_3$ and a line between the third connection point $C_3$ and the third rotation centre $R_3$. The offset angle $\beta_3$ (beta 3) is in this exemplary embodiment 3.03 degrees.

Similarly, the connection point $C_1$, and thus the guiding mechanism 80, is arranged slightly offset from a centre axis $Q_1$ of the first linkage member 28. Accordingly, an offset angle $\beta_1$ (beta 1) is defined between the centre axis $Q_1$ and an imaginary straight line between the first connection point $C_1$ (which in this example refers to exactly the centre of the lower guiding mechanism 82) and the first pivot point $P_1$. The offset angle $\beta_1$ (beta 1) is in this exemplary embodiment 1.95 degrees.

Moreover, the length $L_3$ (as measured along $Q_3$) of the third linkage member 58 is 803 mm. The length $L_3$ of the third linkage member 58 here is defined as the distance between the third rotation centre $R_3$ and the third pivot point $P_3$.

In FIG. 2*b*, the main beam 12 is rotatably connected to the third linkage member 58 of the third main wheel assembly at a distance from the third rotation centre $R_3$. Hence, a length $L_{31}$ is defined between the connection point $C_3$ and the third rotation centre $R_3$. In the exemplary embodiment in FIG. 2*b*, the length $L_{31}$ is 100 mm.

Moreover, the length $L_1$ of the first linkage member 28 is 250 mm. The length $L_1$ of the first linkage member 28 here is defined as the distance between the first rotation centre $R_1$ and the first pivot point $P_1$.

In FIG. 2*b*, the main beam 12 is connected via the guiding mechanism 80 to the first linkage member 28 of the first main wheel assembly 20 at a distance from the first pivot point $P_1$. Hence, a length $L_G$ is defined between the connection point $C_1$ (which here corresponds to the centre of the lower guiding mechanism 82, i.e. the second rotatable shaft 82) and the first pivot point $P_1$. In the exemplary embodiment in FIG. 2*b*, the length $L_G$ is 231 mm.

As shown in FIG. 2*b*, also the lower guiding mechanism 82 (second rotatable shaft) has a radius $E_G$. In the exemplary embodiment in FIG. 2*b*, the radius of the guiding mechanism is 16 mm.

Furthermore, in the exemplary embodiment in FIG. 2*b*, the radius $E_F$ of the front support wheel unit 14 is 25 mm, the radius $E_1$ of the first driving wheel 24 (and the second driving wheel 34) is 323 mm, and the radius $E_3$ of the third rotatable wheel 54 is 111 mm. Accordingly, the driving wheel radius $E_1$ is typically slightly bigger than the length $L_1$ of the linkage member 28.

Figure 3A:
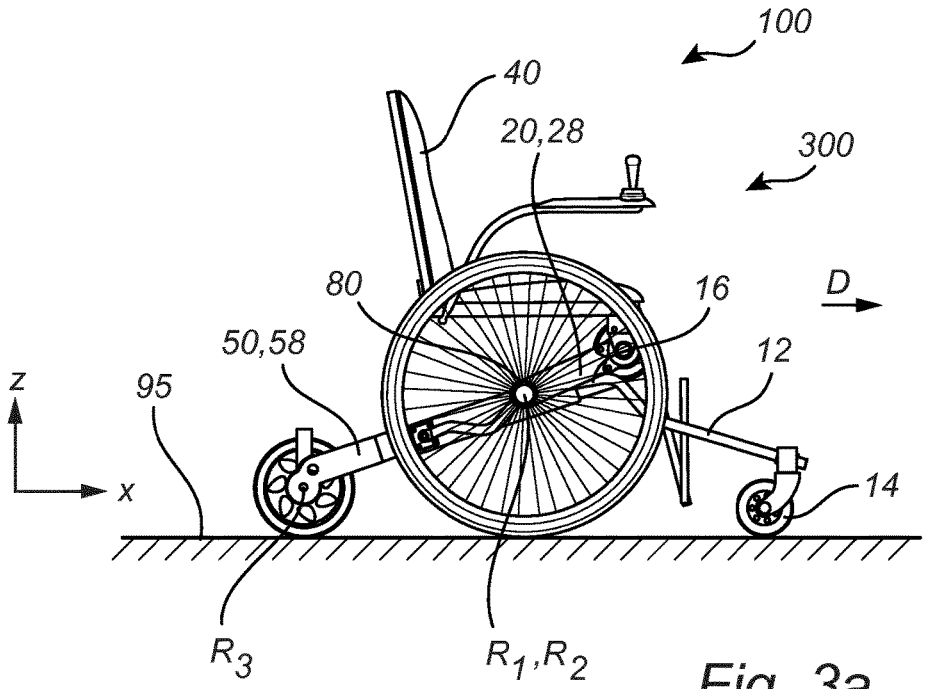
FIGS. 3*a*-3*c* are side views illustrating an exemplary embodiment of the powered wheelchair in an indoor mode, in which the support wheel arrangement is guided via a guiding mechanism according to the present inventive concept.
Figure 3B:
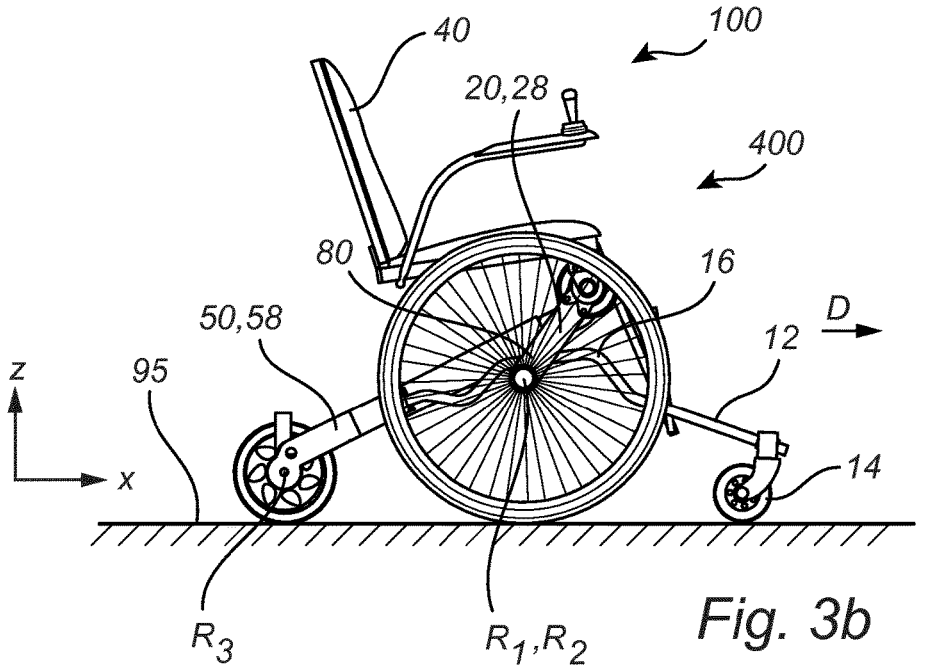
Figure 3C:
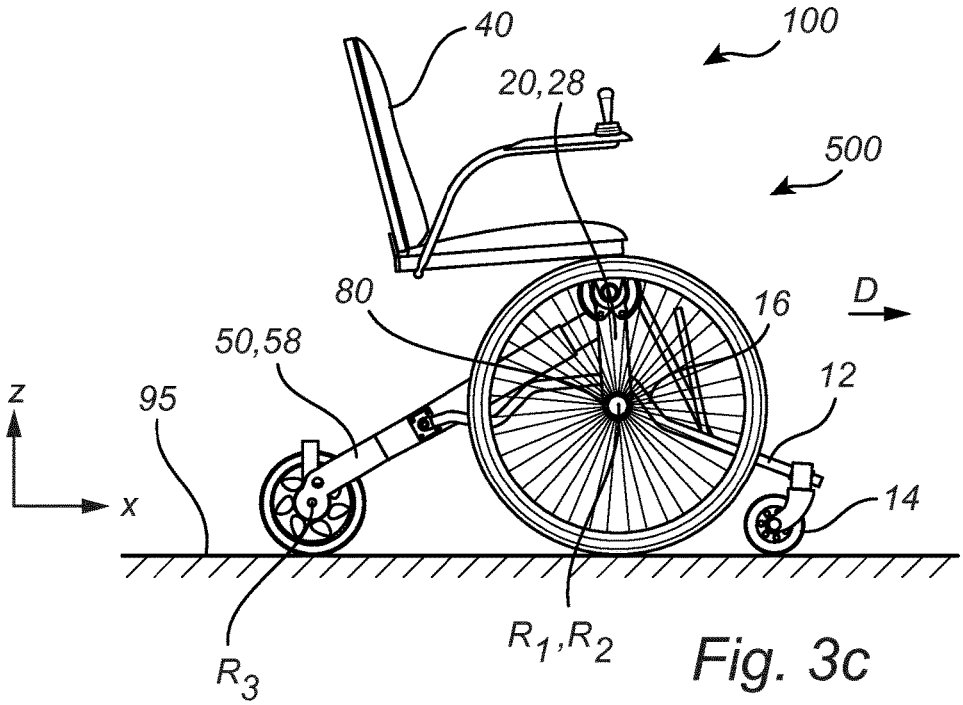

By the above exemplary embodiment, the present inventive concept provides a deviation between the front support wheel unit 14 and the ideal floor level of +/−1.5 mm (typically corresponding to the ground surface 95 as shown in FIG. 2*b*) when moving from an aft position (as illustrated by FIG. 3*a*) to a fore position (as illustrated by FIG. 3*c*).

Hereby, the extension of the first portion in the axial direction may be defined by the length $L_F$ corresponding to the distance between the aft region and the fore region.

Without being bound by any theory, it is believed that a deviation between the front support wheel unit 14 and the ideal floor level of +/−1.5 mm represent an acceptable level of the deviation in order to maintain the support wheel arrangement 10 via the front support wheel unit 14 in the supporting position S.

In addition, the adjustable seat height 74 of the seat frame 40 can be defined between the ground plane 95 and a ground-facing surface 78 of the seat frame. In addition, FIG. 2*b* shows the vertical distance 76 between the pivot points, e.g. pivot point $P_1$ and the ground-facing surface 78. In the exemplary embodiment in FIG. 2*b*, the vertical distance 76 is 200 mm. This distance may also correspond to distance between the seat frame 40 and the horizontal imaginary plane P extending through the pivot points.

Moreover, in this exemplary embodiment, the rotation mechanisms 26, 36, 56 are connected to the seat frame 40 at the front of the seat frame 40, as seen in the longitudinal direction X. More particular, the rotation mechanisms 26, 36, 56 are connected to the seat frame 40 by a distance from a centre area (or point) of the seat frame 40. In other words, each one of the pivot points $P_1$, $P_2$ , $P_3$ is arranged at a distance 75 from the centre area of the seat frame 40. In the exemplary embodiment in FIG. 2*b*, the distance 75 is 150 mm. However, it should be readily appreciated that the distance between a pivot point and the centre area of the seat frame may be different for each pivot point as long as the functions of the inventive concept, as described herein, are not challenged. As an alternative example, the pivot point $P_3$ may be positioned spaced apart from the first pivot point $P_1$ and the second pivot point $P_2$ as seen the in longitudinal direction X.

As mentioned above, the wheelbase(s) can be adjusted via any one of the rotation mechanism(s) to obtain as set of predetermined mode of the powered wheelchair. Accordingly, the wheelbase distance is changed by an adjustment of a position of any one of the main wheel assemblies 20, 30, 50. The various modes of the powered wheelchair 100 will now be described with reference to FIGS. 3*a*-5*b*.

FIGS. 3*a*-3*c* illustrate the exemplary embodiment of the powered wheelchair in FIGS. 1*a*-2*b* in an indoor mode 300, 400, 500 in which the support wheel arrangement 10 is guided via the guiding mechanism 12 according to the present inventive concept.

When the powered wheelchair is in an indoor mode, as shown in FIGS. 3*a*-3*c*, the powered wheelchair has a relatively short wheelbase. A powered wheelchair having a short wheelbase is compact and will therefore fit into small indoor spaces. Also manoeuvring of the wheelchair is enhanced since the two wheels (i.e. the first driving wheel 24 and the second driving wheel 34) are basically centred in the vehicle, which allows for on the spot rotation.

The powered wheelchair 100 can be transformed into the indoor mode 300, 400, 500 by independently operating any one of the first rotation mechanism 26, the second rotation mechanism 36 and the third rotation mechanism 56 to adjust the central wheelbase $w_c$. In the context of the present invention, it is to be noted that since the wheels 24, 34, 54 of the powered wheelchair 100 are typically in contact with the ground surface 95 when any one of the rotation mechanisms are operated, at least during normal use of the wheelchair, an adjustment of the position of any one of the main wheel assemblies 20, 30, 50 may result in that the position (e.g. height) of the seat frame 40 of the wheelchair is changed since the lengths of the linkage members 28, 38, 58 (essentially defining the distance from the wheel to the seat frame) are constant, i.e. the seat height will have to change momentarily during transformation between for example outdoor to indoor mode.

The wheelbase can be shortened by several different operations of the rotation mechanisms in order to transform the wheelchair into the indoor mode. As an example, the first main wheel assembly 20 and the second main wheel assembly 30 may be rotated about their corresponding pivot points $P_1$, $P_2$ in a direction towards the third rotatable wheel 50 (typically corresponding to a direction opposite the travelling direction D), while the third main wheel assembly 50 remains its position or rotates in a direction towards the first and second drive wheel assemblies 20, 30 (typically corresponding to the travelling direction D). In order to transform the powered wheelchair in rapid and smooth manner, the first main wheel assembly 20 and the second main wheel assembly 30 can simultaneously pivot about their corresponding pivot points $P_1$ and $P_2$ in an aligned manner, i.e. the wheel assemblies 20, 30 rotate at the same time and at the same pivoting speed.

It should be readily appreciated that the ultimate pivoting of the rotation mechanism(s) 26, 36, 56 to transform the wheelchair into the indoor mode may depend on the initial wheelbase distance.

A powered wheelchair having a short wheelbase (indoor mode) may typically refer to a configuration of the powered wheelchair in which the first rotation centre R1 and the second rotation centre R2 are positioned behind the first pivot point P1 and the second point P2, as seen in the longitudinal direction X, as illustrated in FIG. 2*b* or FIG. 3*b*.

The indoor mode may also be defined by the level of the pivoting angles $\alpha_1$, $\alpha_2$ and $\alpha_3$. Although the pivoting angles of an indoor mode may differ for various wheelchair designs, one example of a suitable indoor mode can be obtained by pivoting the first main wheel assembly 20 to a first pivot angle $\alpha_1$ of about 135 degrees, the second main wheel assembly 30 to a second pivot angle $\alpha_2$ of about 135 degrees and the third main wheel assembly 50 to a third pivot angle $\alpha_3$ of about 30 degrees. By this adjustment of the wheelbase to a short wheelbase, the pair of opposing main wheel assemblies 20, 30 is typically positioned in a mid section of the wheelchair (as seen in the longitudinal direction X), as illustrated in e.g. FIG. 3*a*.

FIG. 3*a* illustrates the guiding mechanism 80 in an aft position 300 along the extension of the first portion 16 of the main beam 12, as seen in the axial direction of the first portion which here corresponds to the longitudinal direction X. That is, the guiding mechanism 80 is located in the aft region of the first portion 16. In this position, the powered wheelchair 100 is in the indoor mode having a relatively short wheelbase. Based on the principle of the present inventive concept, i.e. the cooperation between the first portion 16 and the guiding mechanism 80 as described above, the support wheel arrangement 10 is maintained in the supporting position S so that the front support wheel unit is applied to the ground surface 95 during operation of the powered wheelchair 100.

FIG. 3*b* illustrates the guiding mechanism 80 in an essentially mid position 400 along the extension of the first portion 16 of the main beam 12, as seen in the axial direction of the first portion which here corresponds to the longitudinal direction X. Also in this position, the powered wheelchair 100 is in the indoor mode having a relatively short wheelbase (although the wheelbase is slightly increased compared to the position as illustrated in FIG. 3*a*). In other words, the position of the first main wheel assembly 20 and typically also the position of the second main wheel assembly 30 have been adjusted in a direction towards the front of the powered wheelchair, which here corresponds to the driving direction D, so that the wheelbase is slightly increased. Upon this adjustment of the position of the first and second wheel assemblies 20, 30, the first portion 16 passes through a part of the guiding mechanism 80 upon movement of the main beam 12 relative to the guiding mechanism 80. Meanwhile, and as is illustrated in FIG. 3*b*, the support wheel arrangement 10 is maintained in the supporting position S.

Hence, despite that the position of the first main wheel assembly 20 and the position of the second main wheel assembly 30 have been adjusted to slightly increase the wheelbase, the support wheel arrangement 10 is maintained in the supporting position S upon movement of the main beam 12 relative to the guiding mechanism 80, due to the cooperation between the first portion 16 and the guiding mechanism 80, so that the front support wheel unit 14 is applied to the ground surface 95 during operation of the powered wheelchair 100.

FIG. 3*c* illustrates the guiding mechanism 80 in a fore position 500 along the extension of the first portion 16 of the main beam 12, as seen in the axial direction of the first portion which here corresponds to the longitudinal direction X. That is, the guiding mechanism 80 is located in the fore region of the first portion 16. Analogous to the position in FIG. 3*b*, the powered wheelchair 100 is in the indoor mode having a relatively short wheelbase (although the wheelbase is slightly increased compared to the position as illustrated in FIG. 3*b*). In other words, the position of the first main wheel assembly 20 and typically also the position of the second main wheel assembly 30 have been adjusted in a direction towards the front of the powered wheelchair, which here corresponds to the driving direction D, so that the wheelbase is slightly increased. Upon this adjustment of the position of the first and second wheel assemblies 20, 30, another part of the first portion 16 passes through a part of the guiding mechanism 80 upon movement of the main beam 12 relative to the guiding mechanism 80. Meanwhile, and as is illustrated in FIG. 3*c*, the support wheel arrangement 10 is maintained in the supporting position S.

Hence, despite that the position of the first main wheel assembly 20 and the position of the second main wheel assembly 30 have been adjusted a further distance to slightly increase the wheelbase, the support wheel arrangement 10 is maintained in the supporting position S upon movement of the main beam 12 relative to the guiding mechanism 80, due to the cooperation between the first portion 16 and the guiding mechanism 80, so that the front support wheel unit 14 is applied to the ground surface 95 during operation of the powered wheelchair 100.

It is to be noted that although the description above mainly refers to a situation in which the main beam is moved in relation to the guiding mechanism by an adjustment of the first main wheel assembly 20 (and typically the second main wheel assembly 30), the principle is likewise applicable to a situation when the main beam is moved in relation to the guiding mechanism by an adjustment of the third main wheel assembly 50.

Further, it is to be noted that the mid section of the powered wheelchair 100 may here be defined by the extension of the seat frame 40 in the longitudinal direction X. Hence, the meaning of the provision that the pair of opposing main wheel assemblies 20, 30 is typically positioned in a mid section of the wheelchair refers to the situation when the rotation centres $R_1$ and $R_2$ are positioned essentially underneath the seat frame, as seen in the vertical direction Z, and within the extension of the seat frame 40, as illustrated by FIGS. 3*a*-3*c*. Accordingly, the wheelbase may be shortened such that the powered wheelchair is in an indoor mode, where the pair of the opposing drive wheel assemblies 20, 30 is positioned in a mid section of the powered wheelchair, as seen in the longitudinal direction X of the powered wheelchair, typically corresponding to the travelling direction D. Hence, the outdoor mode typically refers to a situation when the rotation centres $R_1$ and $R_2$ are positioned essentially in the front of the seat frame 40, as seen in the longitudinal direction X, and as illustrated by FIG. 3*d*.

Figure 3D:
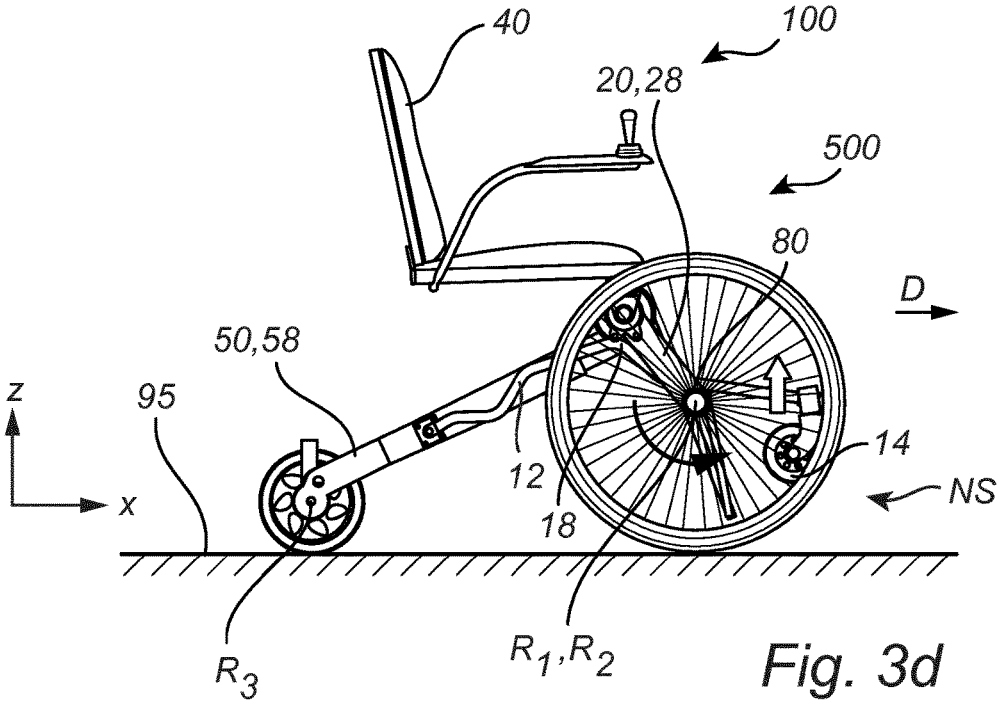
FIG. 3*d* is a side view illustrating an exemplary embodiment of the powered wheelchair in an outdoor mode, in which the support wheel arrangement is in a non-supporting position.

FIG. 3*d* illustrates the exemplary embodiment of the powered wheelchair in FIGS. 1*a*-2*b* in an outdoor mode 600, in which the support wheel arrangement is in a non-supporting position. More specifically, the support wheel arrangement 10 has here been guided via the guiding mechanism 12 and the arcuate shaped portion 18 of the main beam 12 so that the support wheel arrangement has moved from the supporting position S, as shown in FIGS. 3*a*-3*c*, to the non-supporting position NS.

When the powered wheelchair is in the outdoor mode 600, as shown in FIG. 3*d*, the powered wheelchair 100 is considered to have a long wheelbase. This configuration has the advantage of getting front drive wheels in front of the leg or foot rest assembly that are normally used, in order to for example climb up a curb without collision with foot rest.

The powered wheelchair 100 is here transformed to the outdoor mode by independently operating the first rotation mechanism 26, the second rotation mechanism 36 and the third rotation mechanism 56 to adjust the central wheelbase $w_c$.

As an example, the position of the first main wheel assembly 20 and typically also the position of the second main wheel assembly 30 have been further adjusted in a direction towards the front of the powered wheelchair, which here corresponds to the driving direction D, so that the wheelbase is increased to the long wheelbase. Upon this adjustment of the position of the first and second wheel assemblies 20, 30, the arcuate shaped portion 18 portion 16 passes through a part of the guiding mechanism 80 upon movement of the main beam 12 relative to the guiding mechanism 80, causing the support wheel arrangement 10 to move from the supporting position S, in which the front support wheel unit 14 is applied to the ground surface, to the non-supporting positions NS, in which the front support wheel unit 14 is in a raised configuration.

In the context of the present invention, it is to be noted that since the wheels 24, 34, 54 of the powered wheelchair 100 are typically in contact with the ground surface 95 when any one of the rotation mechanisms are operated, at least during normal use of the wheelchair, an adjustment of the position of any one of the wheel assemblies may result in that the position (e.g. height) of the seat frame 40 of the wheelchair is changed since the lengths of the linkage members 28, 38, 58 (essentially defining the distance from the wheel to the seat frame) are constant. The wheelbase can be increased by several different operations of the rotation mechanisms in order to transform the wheelchair into the outdoor mode. As an example, the first main wheel assembly 20 and the second main wheel assembly 30 may be rotated about their corresponding pivot points $P_1$ and $P_2$ in a direction away from the third main wheel assembly 50 (typically corresponding to the travelling direction D), while the third main wheel assembly 50 remains its position or rotates in a direction away from the first and second drive wheel assemblies 20, 30 (typically corresponding to a direction opposite the travelling direction D). In order to transform the powered wheelchair in rapid and smooth manner, the first main wheel assembly 20 and the second main wheel assembly 30 can simultaneously pivot about their corresponding pivot points $P_1$ and $P_2$ in an aligned manner, i.e. the wheel assemblies 20, 30 rotate at the same time and essentially at the same pivoting speed. A long wheelbase (outdoor mode) may also be obtained by pivoting the third main wheel assembly 50 in a direction away from the first driving wheel assembly 20 and the second driving wheel assembly 30, typically corresponding to a direction opposite the travelling direction D, while the first driving wheel assembly 20 and the second driving wheel assembly 30 remain their position or rotate in a direction away from the third main wheel assembly 50 (typically corresponding to the travelling direction D). This type of operation may for instance be utilized when the powered wheelchair is transformed from a stand-up mode into the outdoor mode. It should be readily appreciated that the ultimate pivoting of the rotation mechanism(s) 26, 36, 56 to transform the wheelchair into the outdoor mode may depend on the initial wheelbase distance.

The drive system is normally disabled during transformation between the modes, but in order to preserve the overall position in driving direction, the drive wheels may compensate for the effective change of position between the drive wheels and seat frame to effectuate a transformation without movement of the seat relative to ground.

A powered wheelchair having a long wheelbase (outdoor mode) may typically refer to a configuration of the powered wheelchair in which the first rotation centre R1 and the second rotation centre R2 are positioned in front of the first pivot point P1 and the second point P2, as seen in the longitudinal direction X, as illustrated in FIG. 3*d*.

The outdoor mode may also be defined by the level of the pivoting angles $\alpha_1$, $\alpha_2$, $\alpha_3$. Although the pivoting angles of an outdoor mode may differ for various wheelchair designs, one example of a suitable outdoor mode can be obtained by pivoting the first main wheel assembly 20 to a first pivot angle $\alpha_1$ of about 45 degrees, the second main wheel assembly 30 to a second pivot angle $\alpha_2$ of about 45 degrees and the third main wheel assembly 50 to a third pivot angle $\alpha_3$ of about 30 degrees.

By this adjustment of the wheelbase to a long wheelbase, the pair of opposing main wheel assemblies 20, 30 is typically positioned in the front of the wheelchair (as seen in the longitudinal direction X), as illustrated in FIG. 3*d*. Accordingly, the wheelbase may be increased such that the powered wheelchair 100 is in an outdoor mode, where the pair of the opposing main wheel assemblies 20, 30 is positioned in front of the seat frame 40 of the powered wheelchair, as seen in the longitudinal direction X of the powered wheelchair, typically corresponding to the travelling direction D. In the exemplary embodiment when the pair of opposing main wheels are provided as front driving wheels 24, 34 having a large diameter (typically also larger than the third rotatable wheel), the powered wheelchair is provided with an improved obstacle climbing ability. Especially, in a situation when each one of the first front driving wheel 24 and the second front driving wheel 34 are separately controlled via the rotation mechanisms 26, 36, respectively, this type of arrangement allows for inclinometer sensor feedback (e.g. by utilizing a sensor), while maintaining the seat frame 40 in a constant horizontal plane regardless of terrain. This type of arrangement is particularly useful when the powered wheelchair drives into a kerbstone at a slant angle, which may be traversed by a wheel-by-wheel climbing of the first and second drive wheel assemblies 20, 30.

FIG. 4*a* is a perspective view illustrating an exemplary embodiment of the powered wheelchair in the outdoor mode 600 as described above, in which the support wheel arrangement is in the non-supporting position NS. The powered wheelchair 100 is here illustrated in the form of a wheelchair having the first support wheel arrangement 10 and the second support wheel arrangement 10'. As may be gleaned from FIG. 4*a*, the first support wheel arrangement 10 and the second support wheel arrangement 10' are in the non-supporting position NS and NS', respectively, in which the first front wheel unit 14 and the second front wheel unit 14' are in a raised configuration, i.e. above the ground surface 95.

FIG. 4*b* is a perspective view illustrating an exemplary embodiment of the powered wheelchair in the indoor mode 300 as described above in relation to FIG. 3*a*, in which the support wheel arrangement is in the supporting position S. The powered wheelchair 100 is here illustrated in the form of a wheelchair having the first support wheel arrangement 10 and the second support wheel arrangement 10'. As may be gleaned from FIG. 4*b*, the first support wheel arrangement 10 and the second support wheel arrangement 10' are in the supporting position S and S', respectively, in which the first front wheel unit 14 and the second front wheel unit 14' are applied to the ground surface 95 to support the powered wheelchair.

Figure 5A:
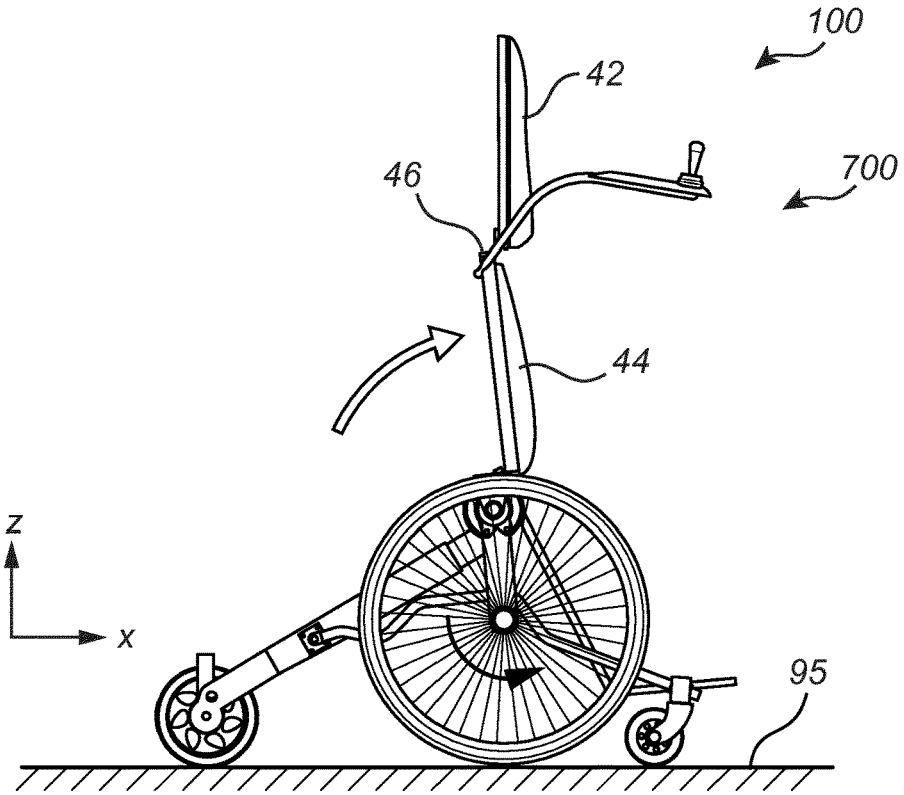
FIGS. 5*a*-5*b* illustrate an exemplary embodiment of the powered wheelchair in a stand-up mode, in which the seat frame of the powered wheelchair is in an essentially vertical orientation and the support wheel arrangement is in a supporting position.
Figure 5B:
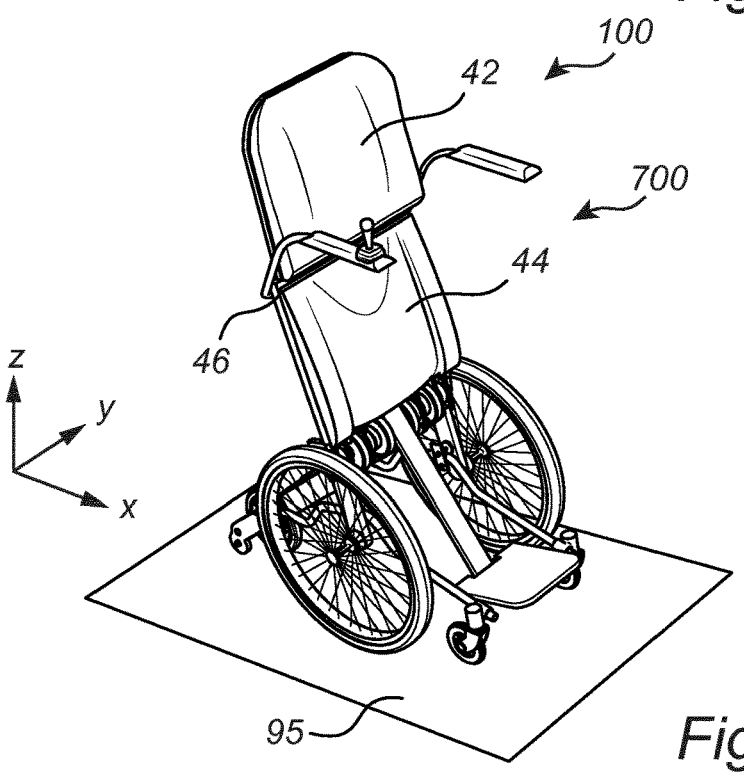

FIGS. 5*a*-5*b* illustrate the exemplary embodiment of the powered wheelchair in FIGS. 1*a*-4*b* in a stand-up mode, in which the seat frame of the powered wheelchair is in an essentially vertical orientation and the support wheel arrangement is in a supporting position. The stand-up mode corresponds to an essentially vertical orientation of the powered wheelchair 100, as seen in a vertical direction Z. In this exemplary embodiment, and in other exemplary embodiments, the seat frame 40 may include a first support section 42 pivotably connected to a second support section 44, wherein the wheelbase $w_c$ is adjusted such that seat frame 40 is positioned in a substantially vertical orientation (up-right position). In this manner, the powered wheelchair 100 transforms into the stand-up mode. In other words, the stand-up mode here refers to a mode when the seat frame 40 is in an essentially vertical orientation, as seen relative to the ground plane 95. In this exemplary embodiment, the first support section is a back support section 42, while the second support section is a seat cushion support section 44. The seat cushion support section 44 is here connected to the back support section 42 by a joint 46. The joint is configured to angle the back support section 42 relative to the seat cushion support section 44 so that the seat frame 40 can adopt different positions based on the desired support for the passenger. The joint 46 may typically include a rotary actuator to effectuate the movement of the back support section 42 relative to the seat cushion support section 44.

Similar to the modes relating to the outdoor mode and the indoor mode, the powered wheelchair can transform into the substantially vertical orientation (up-right position) of the seat frame by independently operating the first rotation mechanism 26, the second rotation mechanism 36 and the third rotation mechanism 56 to adjust the central wheelbase $w_c$. Simultaneously, or slightly after the adjustment of the wheelbase, the joint 46 should be adjusted accordingly in order to ensure that the back support section 42 is sufficiently angled relative to the seat cushion support section 44. The joint may be operated by the control unit 70 similar to the situation with the rotation mechanisms. Hence, the control unit here is configured to operate the rotation mechanisms 26, 36, 56 and the joint 46. The stand-up mode can be obtained by adjusting the wheelbase in several different ways. Since several alternatives of pivoting the rotation mechanisms have been mentioned above, it should be readily appreciated that the ultimate pivoting of the rotation mechanisms to transform the wheelchair into the stand-up mode may depend on the initial wheelbase distance.

As shown by the various situations (or modes) illustrated in FIGS. 3*a* through 5*b*, the powered wheelchair is capable of providing an improved control function, while enabling a transformation between various operational modes, such as indoor mode, outdoor mode and a stand-up mode. Hence, the present inventive concept may hereby also alleviate the drawbacks of many conventional powered wheelchairs. In addition, since the pair of the opposing driving wheel assemblies 20, 30 and the third main wheel assembly 50 are connected to the seat frame, the user of the wheelchair may select to adjust the position of the seat frame by adjusting the position of any one of the wheel assemblies, e.g. by pivoting a wheel assembly about its corresponding pivot point.

Furthermore, as mentioned above, the first main wheel assembly 20 and the second main wheel assembly 30 can be simultaneously operated, e.g. by the control unit. In this manner, the pair of opposing main drive assemblies can be adjusted in synchronism and substantially at the same speed in order to directly adjust the central wheelbase of the powered wheelchair. Typically, the first main wheel assembly 20, the second main wheel assembly 30 and the third main wheel assembly 50 are pivoting about their corresponding pivot points in synchronism to tilt the seat frame in a smooth manner.

In addition, in all exemplary embodiment of the present inventive concept, the powered wheelchair 100 may further comprise an accelerometer (not shown) to operate any one of the first rotation mechanism 20, the second rotation mechanism 30 and the third rotation mechanism 50. In addition, or alternatively, the powered wheelchair 100 may further comprise a gyro (not shown) to operate any one of the first rotation mechanism 20, the second rotation mechanism 30 and the third rotation mechanism 50. In this manner, the powered wheelchair can be controlled (or operated) such that a levelled position of the seat frame is maintained regardless of terrain.

As mentioned above, the powered wheelchair may also include a control unit 70, as illustrated in e.g. FIG. 1*a*. The control unit can be configured in several different ways according to the requirements and functions of the powered wheelchair. As an example, the control unit 70 can be configured to operate any one of the first rotation mechanism 26, the second rotation mechanism 36 and the third rotation mechanism 56. In addition, or alternatively, the control unit 70 may be configured to adjust any one of the wheelbases $w_1$, $w_2$, $w_c$ of the powered wheelchair 100 based on an operation of any one of the first rotation mechanism 26, second rotation mechanism 36 and third rotation mechanism 56. In addition, or alternatively, the control unit may be configured to adjust a tilt angle of a part of the seat frame 40 by operating any one of the first rotation mechanism, second rotation mechanism and third rotation mechanism.

In all exemplary embodiments of the present inventive concept, the powered wheelchair 100 may be powered by an electric motor.

In all exemplary embodiments of the present inventive concept, a rotation mechanism may be provided in the form of a rotary actuator. One example of a rotary actuator is a servo. Rotary actuators are commercially available and can be provided in many sizes and shapes. One example of a suitable control unit or control system can be provided by a central processor which is configured to evaluate signals from the inclinometer and the joystick. The central processor may further be connected via a bus system to local nodes that control each servo motor that is included in the powered wheelchair. For example, the powered wheelchair may include a servo motor for the drive motors, three motors for the above-mentioned rotation mechanisms, a back rest angle motor, a leg rest angle motor and a leg rest length adjustment motor.

Thanks to the present inventive concept, it becomes possible to provide a powered wheelchair that is capable of providing additional support in a situation when the powered wheelchair is operated in indoor mode, typically referring to a situation when the wheelbase of the powered wheelchair is short, in order to ensure a sufficient level of stability. Hereby, a more user-friendly and safer driving environment is provided for the user of the powered wheelchair. In particular, by the configuration of the support wheel arrangement according to the present inventive concept, it becomes possible to maintain the stability of the powered wheelchair upon an adjustment of the wheelbase. More specifically, due to the arrangement of the support wheel arrangement 10, the support wheel arrangement is capable of supporting the powered wheelchair in a smooth and effective manner upon an adjustment of the wheelbase, for instance the central wheelbase distance, in order to provide support when the wheelchair is used in indoor areas, i.e. when the wheelchair is in an indoor mode.

In addition, due to the arrangement that each one of the main wheel assemblies are pivotable arranged, it becomes possible to independently operate each one of the main wheel assemblies in order to adjust the wheelbase of the powered wheelchair.

It is to be understood that the present invention is not limited to the embodiments described above and illustrated in the drawings; rather, the skilled person will recognize that many changes and modifications may be made within the scope of the appended claims. For example, although the invention has been described in relation to a powered wheelchair having one rear main wheel assembly with a rotatable wheel, it should be readily appreciated that the rear main wheel assembly may include another rotatable wheel.

What is claimed is:

1. A powered wheelchair for transporting a person, comprising a seat frame for supporting the person, a pair of opposing main wheel assemblies, including a first main wheel assembly and a second main wheel assembly connected to the seat frame, and a third main wheel assembly arranged spaced apart from the pair of opposing main wheel assemblies and connected to said seat frame, wherein the first main wheel assembly is pivotable about a first pivot point to adjust a position of the first main wheel assembly, and the third main wheel assembly is pivotable about a third pivot point to adjust a position of the third main wheel assembly, and a support wheel arrangement for supporting the powered wheelchair, said support wheel arrangement having a main beam and a front support wheel unit capable of being applied to a ground surface (95), wherein said main beam is rotatably connected to said third main wheel assembly at a third connection point and connected via a guiding mechanism to the first main wheel assembly at a first connection point, wherein said main beam has a first portion adapted to cooperate with said guiding mechanism when said first portion passes through a part of the guiding mechanism upon movement of the main beam relative to the guiding mechanism, to maintain said support wheel arrangement in a supporting position, in which the front support wheel unit is applied to the ground surface.

2. The powered wheelchair according to claim 1, wherein the movement of the main beam relative to the guiding mechanism is defined by a movement of the guiding mechanism between an aft region of the first portion and a fore region of the first position.

3. The powered wheelchair according to claim 1, wherein said main beam has an arcuate shaped portion adapted to cooperate with the guiding mechanism when said arcuate shaped portion passes through a part of said guiding mechanism upon movement of said main beam relative to the guiding mechanism, causing said support wheel arrangement to move from the supporting position, in which said front support wheel unit is applied to the ground surface, to a non-supporting position, in which said front support wheel unit is in a raised configuration.

4. The powered wheelchair according to claim 3, wherein the curvature of the arcuate shaped portion is curved in more than one plane.

5. The powered wheelchair according to claim 1, wherein the movement of the main beam relative to the guiding mechanism is effected by an adjustment of the position of any one of the first main wheel assembly and the third main wheel arrangement.

6. The powered wheelchair according to claim 5, wherein the movement of the main beam relative to the guiding mechanism is effected by a movement of the third main wheel assembly in a direction away from the first main wheel assembly.

7. The powered wheelchair according to claim 5, wherein the movement of the main beam relative to the guiding mechanism is effected by a movement of the first main wheel assembly in a direction away from the third main wheel assembly.

8. The powered wheelchair according to claim 1, wherein the position of the first main wheel assembly is changed by a pivotal motion of the first main wheel assembly about the first pivot point and/or the position of the third main wheel assembly is changed by a pivotal motion of the third main wheel assembly about the third pivot point.

9. The powered wheelchair according to claim 1, wherein said guiding mechanism includes a first rotatable shaft and a second rotatable shaft, whereby said main beam passes through a part of said guiding mechanism and in-between said first rotatable shaft and said second rotatable shaft upon movement of said main beam relative to said guiding mechanism.

10. The powered wheelchair according to any one of the preceding claims claim 1, wherein said guiding mechanism defines a passage for guiding a movement of the main beam.

11. The powered wheelchair according to claim 1, wherein said pair of opposing main wheel assemblies is a pair of opposing front main wheel assemblies, including a first front main wheel assembly and a second front main wheel assembly, and said third main wheel assembly is a rear main wheel assembly.

12. The powered wheelchair according to claim 11, wherein said first front main wheel assembly is a first front main drive wheel assembly and said second front main wheel assembly is a second front main drive wheel assembly.

13. The powered wheelchair according to claim 1, wherein said second main wheel assembly is pivotable about a second pivot point to adjust a position of said second main wheel assembly, said support wheel arrangement is a first support wheel arrangement, the powered wheelchair further comprising:

a second support wheel arrangement for supporting the powered wheelchair, said second support wheel arrangement having a second main beam and a second front support wheel unit capable of being applied to the ground surface, wherein said second main beam is rotatably connected to said third main wheel assembly at a fourth connection point and connected via a second guiding mechanism to said second main wheel assembly at a second connection point, wherein said second main beam has a first portion adapted to cooperate with said second guiding mechanism when said first portion passes through a part of the second guiding mechanism upon movement of the second main beam relative to said second guiding mechanism, to maintain said second support wheel arrangement in a supporting position, in which the second front support wheel unit is applied to the ground surface.

14. The powered wheelchair according to claim 13, wherein said fourth connection point and said third connection point are arranged on opposite sides of the third main wheel assembly, as seen in a transverse direction Y.

* * * * *